US006815008B2

(12) United States Patent
Ichikawa et al.

(10) Patent No.: US 6,815,008 B2
(45) Date of Patent: Nov. 9, 2004

(54) BAR COATING APPARATUS AND BAR COATING METHOD

(75) Inventors: Kazuki Ichikawa, Shizuoka-ken (JP); Go Nishino, Shizuoka-ken (JP); Nobuyoshi Kaneko, Shizuoka-ken (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 0 days.

(21) Appl. No.: 10/241,612

(22) Filed: Sep. 12, 2002

(65) Prior Publication Data

US 2003/0113456 A1 Jun. 19, 2003

(30) Foreign Application Priority Data

Sep. 13, 2001 (JP) ..... 2001-277542
Sep. 13, 2001 (JP) ..... 2001-277543
Sep. 25, 2001 (JP) ..... 2001-291205
Sep. 28, 2001 (JP) ..... 2001-302877

(51) Int. Cl.[7] ..... B05D 1/28; B05D 3/12; B05C 1/12; B05C 11/02

(52) U.S. Cl. ..... 427/359; 427/428; 118/118; 118/119; 118/244; 118/258; 118/259

(58) Field of Search ..... 118/110, 118, 118/119, 244, 258, 259; 427/428, 359, 361

(56) References Cited

U.S. PATENT DOCUMENTS 4,263,870 A * 4/1981 Saito et al. ..... 118/259
5,582,870 A * 12/1996 Shigesada et al. ..... 427/358
2003/0051371 A1 * 3/2003 Ishizuka et al. ..... 34/444

FOREIGN PATENT DOCUMENTS

JP 2000-107661 * 4/2000

* cited by examiner

*Primary Examiner*—Katherine A. Bareford
(74) *Attorney, Agent, or Firm*—Sughrue Mion, PLLC

(57) ABSTRACT

A bar coating apparatus includes a coating bar for contacting an object to be coated, which object is conveyed in a constant direction, so as to apply a coating solution to and remove excess coating solution from the object to be coated, a weir member for forming a bead of the coating solution between the object to be coated and the coating bar, the weir member being disposed upstream of the coating bar in a direction in which the object to be coated is conveyed, a pressing member for pressing the object to be coated from a side thereof opposite from the coating bar, the pressing member being disposed near the coating bar; and a moving device for moving the pressing member in a thickness direction of the object to be coated.

19 Claims, 23 Drawing Sheets

BAR COATING APPARATUS AND BAR COATING METHOD

BACKGROUND OF THE INVENTION

1. Field of the Invention

The present invention relates to a bar coating apparatus and a bar coating method. More specifically, the invention relates to the bar coating apparatus and the bar coating method that are capable of applying a desired amount of coating solution to an object to be coated.

2. Description of the Related Art

In order to apply a coating solution to an object to be coated such as a metal plate and to remove excessive coating solution from the object to be coated (so-called measurement), a bar coating apparatus 102 as shown in FIG. 23 is conventionally used.

The bar coating apparatus 102 has a columnar coating bar 106, which is arranged so as to contact with a coating surface (lower surface) of a metal plate 104 in a direction perpendicular to a conveyance direction of the metal plate 104 (direction of arrow F1), which is conveyed at a constant conveyance speed. The coating bar 106 rotates due to friction with the metal plate 104 at a peripheral speed equal to the conveyance speed of the metal plate 104. A coating solution 108 is raised by the rotation of the coating bar 106, and a bead 110 is arranged between a weir member 112 and the metal plate 104. Namely, the coating solution in the bead 110 is applied to the metal plate 104 and any excess coating solution is removed (measured) from the metal plate 104.

Plates of various thicknesses are used for the metal plate 104 as an object to be coated. However, with changes in the thickness of the metal plate 104, a clearance between the metal plate 104 and the weir member 112 also changes. As a result, the bead 110 becomes unstable, which causes difficulty in obtaining uniformly coated surface quality.

In addition, the metal plate 104 occasionally flaps vertically and ripples due to conveyance. For this reason, the contacted state between the metal plate 104 and the coating bar 106 cannot be maintained constantly, and the bead 110 occasionally becomes unstable. Particularly recently, the conveyance speed of the metal plate 104 tends to be increased, and thus the possibility of the bead 110 not maintaining stability increases due to the higher speed. When the bead 110 becomes unstable, for example, it becomes difficult to obtain a uniformly coated surface quality because a coating streak is caused by the disturbance of the bead 110.

Further, the instability of the bead 110 due to the increased conveyance speed of the metal plate 104 causes the generation of so-called entrained air (air that is trapped inside the coating solution at the time of coating), which can decrease the coated surface quality. When the clearance between the weir member 112 and the object to be coated (metal plate 104) is large, the effect of the entrained air upon the coating solution is particularly noticeable. Hence, the bead 110 has a tendency to become unstable, and that in turn causes difficulty in obtaining uniform coated surface quality.

Furthermore, factors such as increased conveyance speed of the plate, increased viscosity of the coating solution, and varying conditions at the time of coating can hinder maintenance of stability in the bead 110. Disturbance of the bead results in problems such as difficulty in obtaining uniform coated surface quality due to coating streaks and coating breakage.

SUMMARY OF THE INVENTION

In view of the above facts, an object of the present invention is to provide a bar coating apparatus and a bar coating method, which are capable of obtaining uniformly coated surface qualities by corresponding to the various thickness of the objects to be coated.

In addition, it is another object of the invention to provide a bar coating apparatus and a bar coating method which are capable of obtaining uniformly coated surface quality even if a conveyance speed of an object to be coated is increased or a viscosity of a coating solution is increased.

A first aspect of the invention is a bar coating apparatus comprising: a coating bar for contacting an object to be coated, which object is conveyed in a constant direction, so as to apply a coating solution to and remove excess coating solution from the object to be coated; a weir member for forming a bead of the coating solution between the object to be coated and the coating bar, the weir member being disposed upstream of the coating bar in a direction in which the object to be coated is conveyed; a pressing member for pressing the object to be coated from a side thereof opposite from the coating bar, the pressing member being disposed near the coating bar; and a moving device for moving the pressing member in a thickness direction of the object to be coated.

Further, in the first aspect, the pressing member is a pressing roll that is rotatingly driven by friction with the object to be coated.

Furthermore, in the first aspect, the bar coating apparatus further comprises a rotational drive for rotating the coating bar at a peripheral speed that differs from a peripheral speed corresponding to the speed at which the object to be coated is conveyed.

A second aspect of the invention is a bar coating method of bringing a coating bar into contact with an object to be coated, which object is conveyed in a constant direction, so as to apply a coating solution to and remove excess coating solution from the object to be coated, comprising the steps of: supplying the object to be coated; pressing, with a pressing member disposed near the coating bar, the object to be coated from a side thereof opposite from the coating bar; and moving, in correspondence to a coating state, the pressing member in a thickness direction of the object to be coated.

Further, in the second aspect of the invention, the coating bar is rotated at a peripheral speed that differs from a peripheral speed corresponding to the speed at which the object to be coated is conveyed.

In the bar coating apparatus according to the first aspect, the coating bar is brought into contact with the object to be coated, which is conveyed, and the coating solution is applied to the object to be coated. The object to be coated is pressed by the pressing member from the opposite side of the coating bar in the vicinity of the coating bar. The pressing member can be moved in a thickness direction of the object to be coated by the moving apparatus. Therefore, even if the objects to be coated have various thicknesses, the pressing member is moved, and the clearance between the object to be coated and the weir plate is adjusted, so that the bead of the coating solution formed among the weir member, the coating bar and the object to be coated can be stabilized. For this reason, a coated surface quality of the object to be coated is also stabilized, and even if the object to be coated has various thicknesses, the uniform coated surface quality can be obtained.

In addition, a member that merely contacts and presses the object to be coated may be used as the pressing member. However, when the pressing member is a pressing roll, which is driven to rotate by friction with the object to be coated, the object to be coated can be prevented from being rubbed and damaged by the pressing roll.

Further, when the coating bar is not rotated by the friction with the object to be coated, but is actively rotated by the rotation drive at a peripheral speed different from a peripheral speed corresponding to the conveyance speed of the object to be coated, the bead formed among the weir plate, the coating bar and the object to be coated can be stabilized. Therefore, for example, even in the case where the conveyance speed of the object to be coated is increased and the viscosity of the coating solution is increased, the uniform coated surface quality can be obtained.

In the bar coating method according to the second aspect, the coating bar is brought into contact with the object to be coated, which is conveyed, and the coating solution is transferred and applied to the object to be coated. The object to be coated is pressed from the opposite side of the coating bar by the pressing member in the vicinity of the coating bar, and the pressing member is moved in the thickness direction of the object to be coated according to a coating state. Therefore, the pressing member is moved in the thickness direction of the object to be coated in accordance to the various thickness of the object to be coated, so that the clearance between the object to be coated and the weir member is adjusted and the bead can be stabilized. For this reason, the coated surface quality of the object to be coated is also stable, and the uniform coated surface quality can be obtained even when the object to be coated has various thickness.

In addition, the coating bar is not rotated by friction with the object to be coated and the coating bar, but is actively rotated at a peripheral speed different from a peripheral speed corresponding to the conveyance speed of the object to be coated. As a result, the bead formed among the weir plate, the coating bar and the object to be coated can be stabilized. Therefore, for example, even in cases where the conveyance speed of the object to be coated is increased and the viscosity of the coating solution is increased, the uniform coated surface quality can be obtained.

A third aspect of the invention is a bar coating apparatus comprising: a coating bar for contacting an object to be coated, which object is conveyed in a constant direction, so as to apply a coating solution to and remove excess coating solution from the object to be coated; a weir member for forming a bead of the coating solution between the object to be coated and the coating bar, the weir member being disposed upstream of the coating bar in a direction in which the object to be coated is conveyed; and a pressing member for pressing the object to be coated from a side thereof opposite from the coating bar, the member being disposed near the coating bar.

Further, in the third aspect, the pressing member is a pressing roll that is rotatingly driven by friction with the object to be coated.

Furthermore, in the third aspect, the bar coating apparatus further comprises a rotational drive for rotating the coating bar at a peripheral speed that differs from a peripheral speed corresponding to the speed at which the object to be coated is conveyed.

A fourth aspect of the invention is a bar coating method of bringing a coating bar into contact with an object to be coated, which object is conveyed in a constant direction, so as to apply a coating solution to and remove excess coating solution from the object to be coated, comprising the steps of: supplying the object to be coated; and pressing, with a pressing member disposed near the coating bar, the object to be coated from a side thereof opposite from the coating bar.

Further, in the fourth aspect of the invention, the coating bar is rotated at a peripheral speed that differs from a peripheral speed corresponding to the speed at which the object to be coated is conveyed.

In the bar coating apparatus according to the third aspect, the coating bar is brought into contact with the object to be coated, which is conveyed, and the coating solution is applied to the object to be coated. The object to be coated is pressed by the pressing member from the opposite side of the coating bar in the vicinity of the coating bar. Therefore, flapping of the object to be coating during conveyance is prevented, and the bead of the coating solution formed among the weir member, the coating bar and the object to be coated is stabilized. For this reason, a coated surface quality of the object to be coated is also stabilized. Further, even if, for example, the conveyance speed of the object to be coated is increased, the uniform coated surface quality can be obtained.

In addition, a member that merely contacts and presses the object to be coated may be used as the pressing member. However, when the pressing member is a pressing roll, which is driven to rotate by friction with the object to be coated, the object to be coated can be prevented from being rubbed and damaged by the pressing roll.

Further, the coating bar is not rotated by friction with the object to be coated, but is actively rotated at a peripheral speed different from a peripheral speed corresponding to the conveyance speed of the object to be coated. As a result, the bead formed among the weir plate, the coating bar and the object to be coated can be stabilized. Therefore, for example, even in cases where the conveyance speed of the object to be coated is increased and the viscosity of the coating solution is increased, the uniform coated surface quality can be obtained.

In the bar coating method according to the fourth aspect, the coating bar is brought into contact with the object to be coated, which is conveyed, and the coating solution is transferred and applied to the object to be coated. The object to be coated is pressed from the opposite side of the coating bar by the pressing member in a vicinity of the coating bar. Therefore, the flapping of the object to be coated during conveyance is prevented, and the bead of the coating solution is stabilized. For this reason, the coated surface quality of the object to be coated is also stable. Further, even if, for example, the conveyance speed of the object to be coated is increased, the uniform coated surface quality can be obtained.

In addition, the coating bar is not rotated by friction with the object to be coated, but is actively rotated at a peripheral speed different from a peripheral speed corresponding to the conveyance speed of the object to be coated. As a result, the bead formed among the weir member, the coating bar and the object to be coated can be stabilized. Therefore, for example, even in cases where the conveyance speed of the object to be coated is increased and the viscosity of the coating solution is increased, the uniform coated surface quality can be obtained.

A fifth aspect of the invention is a bar coating apparatus comprising: a coating bar for contacting an object to be coated, which object is conveyed in a constant direction, so as to apply a coating solution to and remove excess coating solution from the object to be coated; a weir member for forming a bead of the coating solution between the object to be coated and the coating bar, the weir member being disposed upstream of the coating bar in a direction in which the object to be coated is conveyed; and a clearance-maintaining mechanism for maintaining clearance between the weir member and the object to be coated at a predetermined value of no more than 5 mm.

Further, in the fifth aspect, the bar coating apparatus further comprises a pressing member for pressing the object to be coated from a side thereof opposite from the coating bar, the member being disposed near the coating bar, wherein the clearance-maintaining mechanism comprises a moving device for moving at least one of the weir member and the pressing member in a thickness direction of the object to be coated.

Furthermore, in the fifth aspect, the bar coating apparatus further comprises a rotational drive for rotating the coating bar at a peripheral speed that differs from a peripheral speed corresponding to the speed at which the object to be coated is conveyed.

A sixth aspect of the invention is a bar coating method of bringing a coating bar into contact with an object to be coated, which object is conveyed in a constant direction, so as to apply a coating solution to and remove excess coating solution from the object to be coated, comprising the steps of: supplying the object to be coated; and forming a bead of the coating solution between the object to be coated and the coating bar with a weir member disposed upstream of the coating bar in a direction in which the object to be coated is conveyed, wherein clearance between the weir member and the object to be coated is maintained at a predetermined value of no more than 5 mm.

Further, in the sixth aspect, the coating bar is rotated at a peripheral speed that differs from a peripheral speed corresponding to the speed at which the object to be coated is conveyed.

In the bar coating apparatus according to the fifth aspect, the coating bar is brought into contact with the object to be coated, which is conveyed, and the coating solution is applied to the object to be coated. At this time, the bead of the coating solution is formed among the weir member, the coating bar and the object to be coated.

The clearance between the weir member and the object to be coated is maintained in a predetermined value of 5 mm or less by the clearance-maintaining mechanism. When the upper limit of the clearance is defined, the trapping of the entrained air is reduced (preferably, entrained air is not generated), so that the bead can be maintained stably. For this reason, the coated surface quality of the object to be coated is stabilized, and even in the case where the conveyance speed of the object to be coated is increased, the uniform coated surface quality can be obtained.

In addition, the weir member itself may be approached to and/or be separated from the object to be coated, or the pressing member may press the object to be coated and move the object to be coated so as to approach to and/or separate from the weir member.

Further, since the coating bar is not rotated by friction with the object to be coated, but is actively rotated by the rotation drive at a peripheral speed different from a peripheral speed corresponding to the conveyance speed of the object to be coated, the bead formed among the weir plate, the coating bar and the object to be coated can be stable. Therefore, for example, even in cases where the conveyance speed of the object to be coated is increased and the viscosity of the coating solution is increased, the uniform coated surface quality can be obtained.

In the bar coating method according to the sixth aspect, the coating bar is brought into contact with the object to be coated, which is conveyed, and the coating solution is transferred and applied to the object to be coated. At this time, the bead of the coating solution is formed among the weir member, the coating bar and the object to be coated.

Here, the clearance between the weir member and the object to be coated is maintained in a predetermined value of 5 mm or less. When the upper limit of the clearance is defined, the trapping of the entrained air is reduced (preferably, entrained air is not generated), and the bead can be maintained stably. For this reason, the coated surface quality of the object to be coated is stable, and even in the case where, for example, the conveyance speed of the object to be coated is increased, the uniform coated surface quality can be obtained.

In addition, since the coating bar is not rotated by friction with the object to be coated, but is actively rotated at a peripheral speed different from a peripheral speed corresponding to the conveyance speed of the object to be coated. As a result, the bead formed among the weir member, the coating bar and the object to be coated can be stabilized. Therefore, for example, even in cases where the conveyance speed of the object to be coated is increased and the viscosity of the coating solution is increased, the uniform coated surface quality can be obtained.

In the invention, the length of the clearance does not have a lower limit value from a viewpoint of reducing entrained air trapped in the coating solution. However, in order to prevent unnecessary contact of the weir member with the object to be coated, it is preferable that the length is maintained at 0.1 mm or more.

In addition, the "different periphery speed" includes the case where the coating bar rotates in the same direction as the conveyance direction of the object to be coated and the case where the coating bar rotates in the opposite direction of the conveyance direction of the object to be coated.

A seventh aspect of the invention is a bar coating apparatus comprising: a coating bar for contacting an object to be coated, which object is conveyed in a constant direction, so as to apply a coating solution to and remove excess coating solution from the object to be coated; a weir member for forming a bead of the coating solution between the object to be coated and the coating bar, the weir member being disposed upstream of the coating bar in a direction in which the object to be coated is conveyed; and a rotational drive for rotating the coating bar at a peripheral speed that differs from a peripheral speed corresponding to the speed at which the object to be coated is conveyed.

Further, in the seventh aspect, the number of revolutions of the coating bar is within ±500/min.

Furthermore, in the seventh aspect, the bar coating apparatus further comprises a switching mechanism for switching a rotational driving force of the rotational drive between a transmitting state, in which the driving force is transmitted to the coating bar, and a non-transmitting state, in which the driving force is not transmitted to the coating bar.

An eighth aspect of the invention is a bar coating method of bringing a coating bar into contact with an object to be coated, which object is conveyed in a constant direction, so as to apply a coating solution to and remove excess coating solution from the object to be coated, comprising the steps of: supplying the object to be coated; and rotating the coating bar at a peripheral speed that differs from a peripheral speed corresponding to the speed at which the object to be coated is conveyed.

Further, in the eighth aspect, the number of revolutions of the coating bar is within ±500/min.

In the bar coating apparatus according to the seventh aspect, the coating bar is brought into contact with the object to be coated, which is conveyed, and the coating solution is applied to the object to be coated. In the bar coating apparatus, the coating bar is not rotated by friction with the object to be coated, but is actively rotated by the rotation drive so that its peripheral speed is different from a peripheral speed corresponding to the conveyance speed of the object to be coated. As a result, the bead of the coating solution formed among the weir member, the coating bar and the object to be coated can be stabilized. Therefore, for example, in cases where the conveyance speed of the object to be coated is increased and the viscosity of the coating solution is increased, the uniform coated surface quality can be obtained.

In addition, the number of revolutions of the coating bar is not particularly limited as long as its peripheral speed is different from a peripheral speed corresponding to the conveyance speed of the object to be coated. However, the number of revolutions of the coating bar is within ±500/min, so that the bead can be securely stabilized.

Further, the rotational driving force of the rotation drive can be prevented from being transmitted to the coating bar by the switching mechanism. As a result, the coating bar can be rotated by friction with the object to be coated as the conventional structure.

In the bar coating method according to the eighth aspect, the coating bar is not rotated by friction with the object to be coated, but is actively rotated at a peripheral speed different from a peripheral speed corresponding to the conveyance speed of the object to be coated. As a result, the bead of the coating solution can be stabilized. Therefore, for example, even in cases where the conveyance speed of the object to be coated is increased and the viscosity of the coating solution is increased, the uniform coated surface quality can be obtained.

In addition, the number of revolutions of the coating bar is not particularly limited as long as its peripheral speed is different from a peripheral speed corresponding to the conveyance speed of the object to be coated as mentioned above. However, when the number of revolutions of the coating bar is within ±500/min, the bead can be securely stabilized.

The "number of revolution" is indicated by "+" when the contact portion of the coating bar with the object to be coated moves in the same direction as the conveyance direction of the object to be coated. Therefore, when the number of revolutions is indicated by "−", the contact portion of the coating bar with the object to be coated moves in the opposite direction of the conveyance direction of the object to be coated.

DESCRIPTION OF THE PREFERRED EMBODIMENTS

Figure 1:
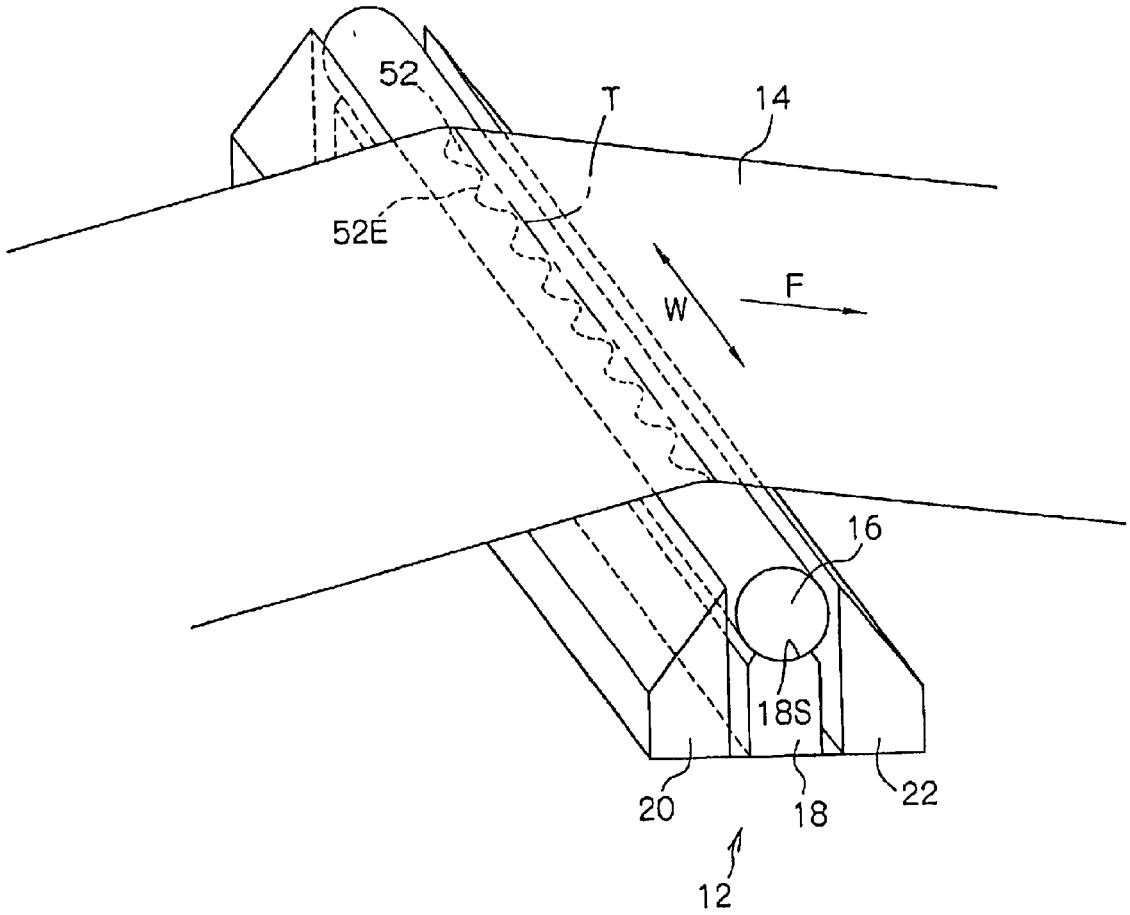
FIG. 1 is a perspective view showing a schematic structure of a bar coating apparatus according to a first embodiment of the present invention.

FIGS. 1, 2A, 2B and 2C show a bar coating apparatus 12 according to a first embodiment of the present invention. The bar coating apparatus 12 is incorporated into a manufacturing line of a planographic printing plate precursor. The bar coating apparatus 12 is used for applying a coating solution 50 (photosensitive solution or the like) to an aluminum web 14, which is a substrate of the planographic printing plate precursor. The aluminum web 14 is conveyed in the longitudinal direction thereof at a predetermined conveyance speed by a conveyance device (not shown). Hereafter, "conveyance direction" refers to the conveyance direction of the aluminum web 14 and the direction is indicated by an arrow F in the drawings. Moreover, "width direction" refers to a direction of the width of the aluminum web 14 and is indicated by an arrow W in the drawings.

The bar coating apparatus 12 has a coating bar 16 which is arranged so as to come in contact with the aluminum web 14 from below. The coating bar 16 is formed into an approximately columnar shape (or approximately cylindrical shape), and is supported by a bearing member 18 so that its longitudinal direction coincides with the width direction of the aluminum web 14.

An upper surface of the bearing member 18 is a supporting surface 18S which is formed into an arc shape along an outer peripheral surface of the coating bar 16. The coating bar 16 contacts the supporting surface 18S and is rotatably supported thereon.

Weir plates 20 and 22 are arranged on upstream and downstream sides of the bearing member 18, respectively. Predetermined clearances are provided between the weir plates 20, 22 and the bearing member 18, respectively. The clearance between the weir plate 20 on the upstream side and the bearing member 18 serves as a coating solution supply path 24. A coating solution 50, which is fed from a coating solution supply device (not shown), passes through the coating solution supply path 24 and is successively raised by rotation of the coating bar 16 so as to be transferred to the aluminum web 14. Further, upstream of the portion at which the aluminum web 14 and the coating bar 16 contact, a bead 52 of the coating solution 50 is formed among the aluminum web 14, the weir plate 20, and the coating bar 16.

Figure 2A:
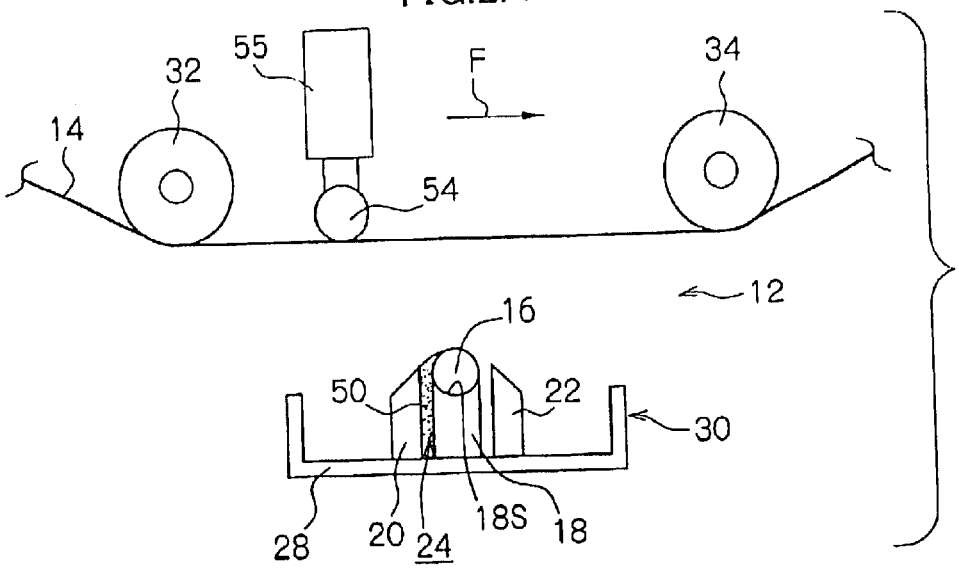
FIG. 2A is a front view showing a schematic structure of the bar coating apparatus when not coating, according to the first embodiment of the invention.
Figure 2B:
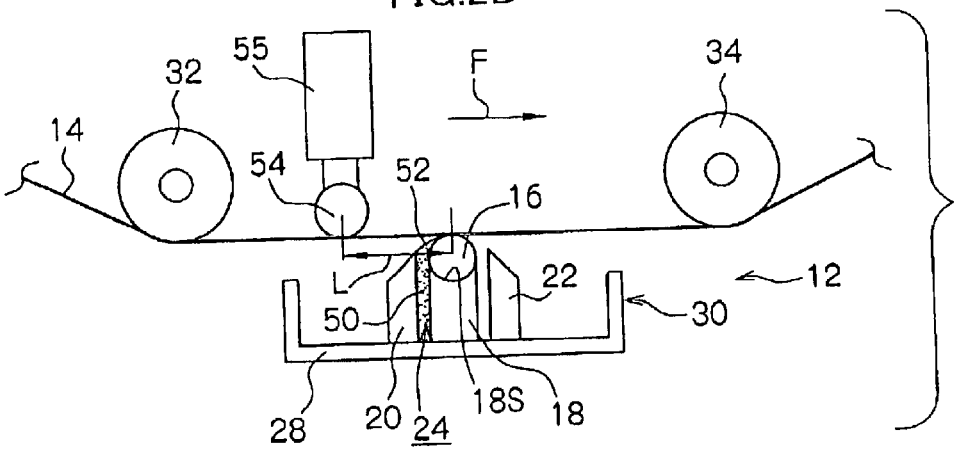
FIG. 2B is a front view showing the schematic structure of the bar coating apparatus when coating, according to the first embodiment of the invention.
Figure 2C:
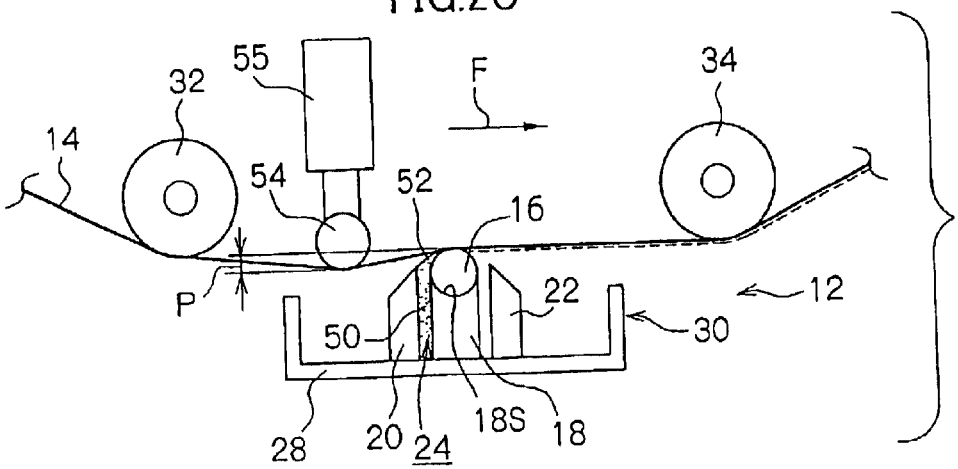
FIG. 2C is a front view showing the schematic structure of the bar coating apparatus when coating, according to the first embodiment of the invention.

As shown in FIGS. 2A, 2B and 2C, the bearing member 18 and the weir plates 20, 22 are held integrally by a holder 28 so as to compose a coating device 30. Moreover, support rolls 32 and 34 which come in contact with the aluminum web 14 from the opposite side to the coating device 30 (i.e., from above the aluminum web 14) are disposed both upstream and downstream of the coating device 30, respectively (in FIG. 1, the support rolls 32 and 34 are not shown). When the support rolls 32 and 34 press down upon the aluminum web 14 from above, a predetermined tension is being applied to the aluminum web 14, and thus, the aluminum web 14 can be brought into contact with the coating bar 16.

When an elevating device (not shown) is driven, the bearing member 18 and the weir plates 20, 22 composing the coating device 30 can be integrally moved vertically. As shown in FIG. 2A, in a state where the coating device 30 is lowered down away from the aluminum web 14, the coating bar 16 does not come in contact with the aluminum web 14. Therefore, the coating solution 50 is not applied to the aluminum web 14. However, as shown in FIG. 2B, by lifting up the coating device 30, the coating bar 16 is brought into contact with the aluminum web 14, and the aluminum web 14 can be coated with the coating solution 50. Further, the contact pressure can be adjusted to a desired pressure by slightly moving the coating device vertically while maintaining the contact between the coating bar 16 and the aluminum web 14. As a result, appropriate coating can be carried out to meet the needs of different types of aluminum webs 14 and coating solutions 50.

Figure 3:
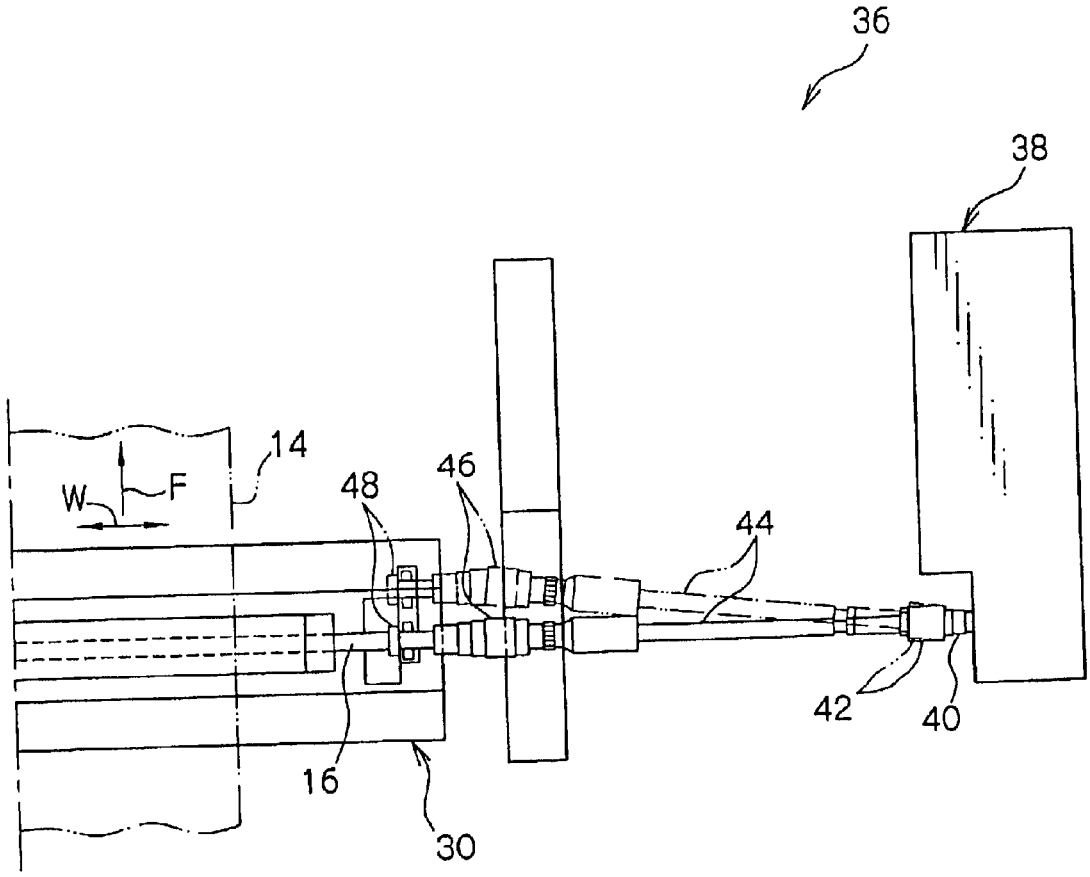
FIG. 3 is a plan view showing a rotation drive of the bar coating apparatus according to the first embodiment of the invention.
Figure 4:
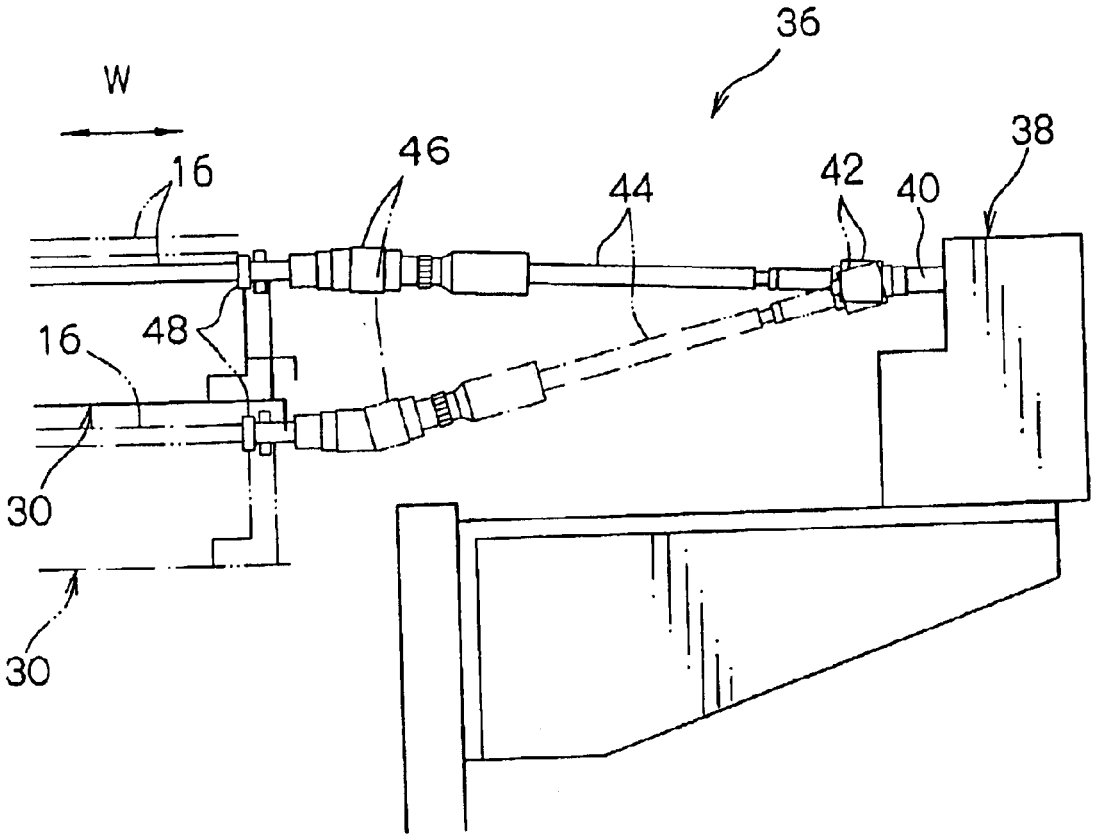
FIG. 4 is a side view showing the rotation drive of the bar coating apparatus according to the first embodiment of the invention.

FIGS. 3 and 4 show schematic structures of a rotation drive 36 for driving the rotation of the coating bar 16.

The rotation drive 36 is structured to include a motor and a reduction device and the like, and has a drive source 38 for generating a rotational driving force at a predetermined torque and at a predetermined angular velocity. An output shaft 40 of the drive source 38 is connected to a shaft 44 via a first universal joint 42. Further, the shaft 44 is connected to a switching member 48 via a second universal joint 46. The switching member 48 moves between a transmission position where the switching member 48 is connected to the coating bar 16 to enable to transmit rotational driving force thereto (a position shown by a solid line in FIG. 3) and a non-transmission position, where the connection with the coating bar 16 is released and the rotational driving force is not transmitted (a position shown by the two-dot chain line in FIG. 3).

In addition, since the drive source 38 is connected to the coating bar 16 via the two universal joints 42 and 46, the rotational driving force of the drive source 38 can be transmitted to the coating bar 16 while an angle between the output shaft 40 of the drive source 38 and the coating bar 16 is being always kept constant (parallel in the present embodiment). For example, in the case where the coating device 30 is slightly moved vertically or, as shown by the two-dot chain line in FIG. 4, the coating device 30 is lowered down so that the coating bar 16 is separated from the aluminum web 14, the output shaft 40 of the drive source 38 is parallel with the coating bar 16, and the coating bar 16 receives the rotational driving force of the drive source 38 so as to rotate.

In the bar coating apparatus 12 of the present embodiment, the coating bar 16 can be actively rotated by the rotational driving force from the drive source 38 so that a peripheral speed of the coating bar 16 differs from a peripheral speed corresponding to the conveyance speed of the aluminum web 14.

A pressing roll 54, which comes in contact with the aluminum web 14 from above the aluminum web 14, namely, the opposite side to the coating bar 16, is disposed between the support roll 32 and the coating bar 16. The pressing roll 54 is rotatably supported by a supporting device 55 so that the axial direction thereof coincides with the width direction of the aluminum web 14. Further, the supporting device 55 supports the pressing roll 54 so as to allow movement in the same direction as a thickness direction of the aluminum web 14 (i.e., the vertical direction). As shown in FIG. 2A, the pressing roll 54 contacts the aluminum web 14 to an extent that planarity of the aluminum web 14 between the support rolls 32 and 34 is not impaired, when the coating device 30 is in the lowered position. The pressing roll 54 rotates due to friction with the aluminum web 14 when the aluminum web 14 is conveyed.

Figure 5:
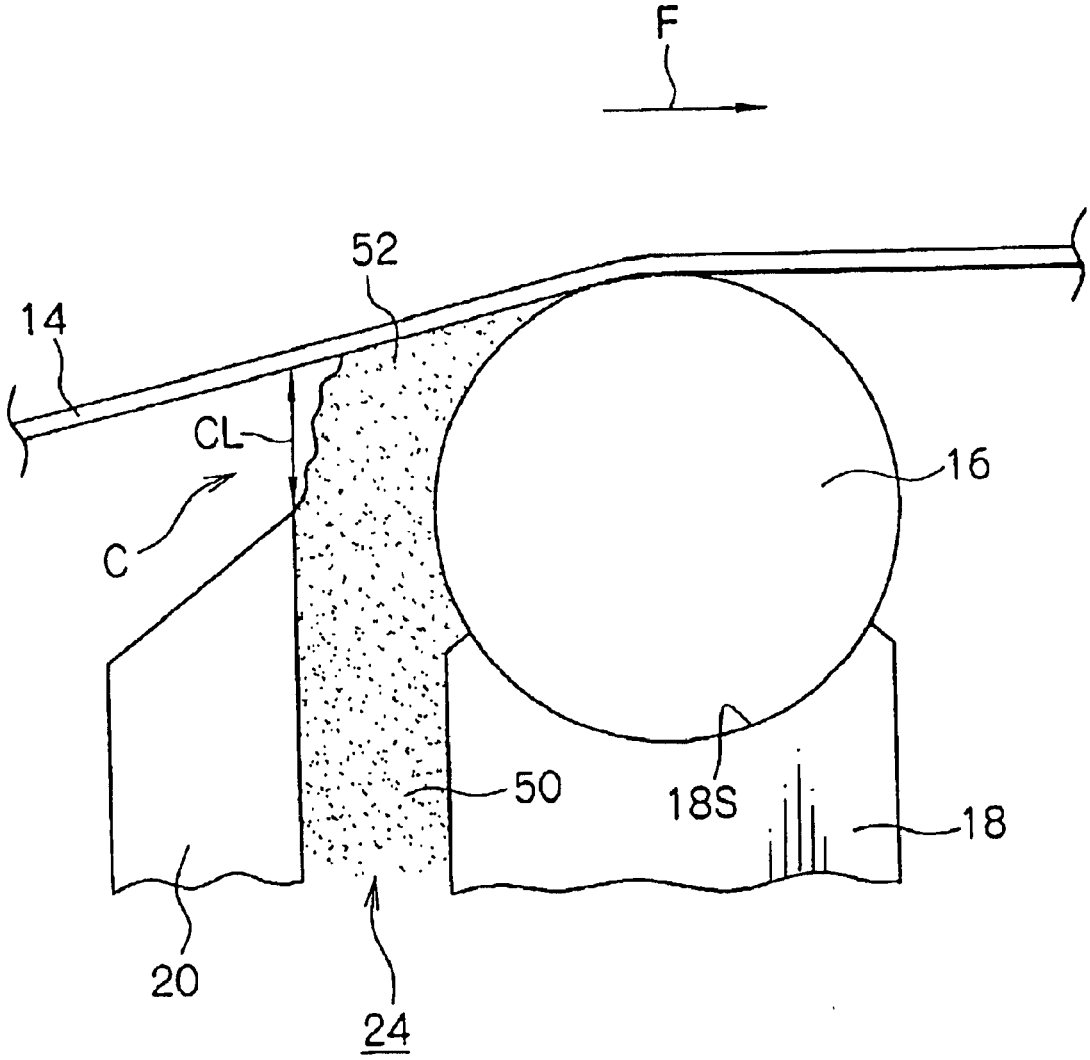
FIG. 5 is an explanatory diagram illustrating a clearance between an aluminum web and a weir plate in the bar coating apparatus of the invention.

In contrast, as shown in FIGS. 2B and 2C, where the coating device 30 is raised and the aluminum web 14 is coated with the coating solution 50, the length CL of the clearance C between the aluminum web 14 and the weir plate 20 (see FIG. 5) can be adjusted by moving the pressing roll 54 vertically against the aluminum 14, which is supported between the support rolls 32 and 34.

The position of the pressing roll 54 in the conveyance direction is not particularly limited as long as the length of the clearance between the aluminum web 14 and the weir plate 20 can be adjusted. As shown in FIG. 2B, if it is assumed that the distance from the center of the coating bar 16 to the center of the pressing roll 54 is a pressing position L when the coating bar 16 and the pressing roll 54 are in contact with the aluminum web 14 so as to allow application of the coating solution 50, it is preferable that the pressing position L is within the range of 10 to 150 mm, and more preferable in the range of 15 to 60 mm.

The vertical position and the amount of vertical movement of the pressing roll 54 are not particularly limited as long as the length CL of the clearance C between the aluminum web 14 and the weir plate 20 is adjusted so that the position and amount can be within a desirable range. As shown in FIG. 2C, if it is assumed that the length from an apex of the coating bar 16 to a lower end position of the pressing roll 54 which is measured in the same direction as the ascent and descent direction of the coating device 30 is a forcing amount P when the coating bar 16 and the pressing roll 54 is in contact with the aluminum web 14 so as to allow application of the coating solution 50, it is preferable that the forcing amount P is within the range of 1 to 30 mm.

Next, a method of applying the coating solution 50 to the aluminum web 14 using the bar coating apparatus 12 of the present embodiment and a function of the bar coating apparatus 12 will now be described.

When the coating solution 50 is applied to the aluminum web 14, the aluminum web 14 is conveyed at a constant conveyance speed by the conveyance device (not shown).

In addition, the coating device 30 is lifted up as shown in FIG. 2B, and the coating bar 16 is brought into contact with the aluminum web 14, and the coating solution 50 is supplied from the coating solution supply device (not shown). Here, in the bar coating apparatus 12 of the present embodiment, the aluminum web 14 is pressed by the pressing roll 54 from the opposite side of the coating bar 16, and the vertical position of the pressing roll 54 is movable by the supporting device 55. Therefore, the length CL of the clearance C between the aluminum web 14 and the weir plate 20 is adjusted, for example, according to a thickness of the aluminum web 14, so that the bead 52 formed among the aluminum web 14, the weir plate 20 and the coating bar 16 can be retained stably. In the cases where the object to be coated is thick, the aluminum web 14 is rigid, and thus the length CL of the clearance C elongates due to lack of pressing by the pressing roll 54. On the other hand, in cases where a relatively thin aluminum web 14 is used, the rigidity of the aluminum web 14 is low and thus the length CL of the clearance C narrows when not being pressed by the pressing roll 54. Therefore, the vertical position of the pressing roll 54 is adjusted and the length CL of the clearance C is kept constant (or nearly constant), so that the bead 52 can be kept stable. As a result, the bead 52 arranged among the aluminum web 14, the weir plate 20 and the coating bar 16 becomes stable. For this reason, coating streak or the like due to disturbance of the bead does not occur in the coated coating solution 50, and an uniformly coated surface quality can be obtained on the aluminum web 14.

Needless to say, the length CL of the clearance C fluctuates due to other factors besides the rigidity of the aluminum web 14. In the bar coating apparatus 12 of the present embodiment, the length CL is maintained constant and the bead 52 can be retained stably regardless of the factors that cause fluctuation of the length CL of the clearance C.

In addition, in the bar coating apparatus 12 of the present embodiment, the switching member 48 is moved to the transmission position of the driving force when coating, as shown by a solid line in FIG. 3. The rotational driving force of the drive source 38 can be transmitted to the coating bar 16. As a result, the coating bar 16 is actively rotated at a peripheral speed, which differs from a peripheral speed corresponding to the conveyance speed of the aluminum web 14.

Generally, when the bead 52 is arranged among the aluminum web 14, the weir plate 20 and the coating bar 16, and the bead 52 is viewed from a contact portion T between the aluminum web 14 and the coating bar 16 (shown by the chain line in FIG. 1), in the case where an edge portion 52E of the bead 52 draws a periodic curved line in the width direction, the coated surface quality becomes fine. Particularly when the edge portion 52E has a sine curve shape or a shape close to a sine curve, the coated surface quality becomes even better.

As mentioned above, the peripheral speed of the coating bar 16 is set to be different from the peripheral speed corresponding to the conveyance speed of the aluminum web 14. As a result, the edge portion 52E of the bead 52 has a shape similar to the sine curve, and the bead 52 is maintained stably. Therefore, streak coating of the coating solution 50 or the like due to disturbance of the bead does not occur, and a uniform coated surface quality can be obtained.

Particularly in cases where the coating solution 50 having a high viscosity is used, or in cases where the conveyance speed of the aluminum web 14 is increased, the edge portion 52E of the bead 52 has a shape similar to a sine curve, and the bead 52 can be maintained stably. Therefore, the coated surface quality can be uniform. From this viewpoint, the rotation speed of the coating bar 16 is not particularly limited as long as it is a peripheral speed different from the peripheral speed corresponding to the conveyance speed of the aluminum web 14.

Needless to say, there are occasions when it is preferable that the coating bar 16 is rotated (driven) by friction with the aluminum web 14 similarly to the conventional structure, depending on the conveyance speed of the aluminum web 14, the viscosity of the coating solution 50 and the other conditions. In such instances, the rotational driving force of the drive source 38 can be easily prevented from being transmitted to the coating bar 16 just by moving the switching member 48 to the non-transmission position of the driving force, as shown by the two-dot chain line in FIG. 3.

A second embodiment of the invention will now be described. Components that are substantially the same as components previously described in the first embodiment are designated by the same reference numerals, and description thereof is omitted.

Figure 6A:
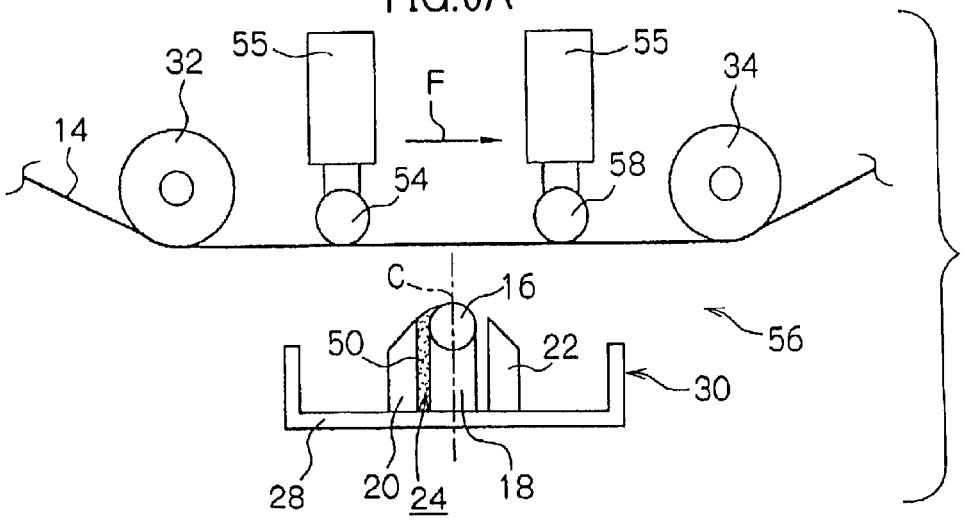
FIG. 6A is a front view showing a schematic structure of the bar coating apparatus when not coating, according to a second embodiment of the invention.
Figure 6B:
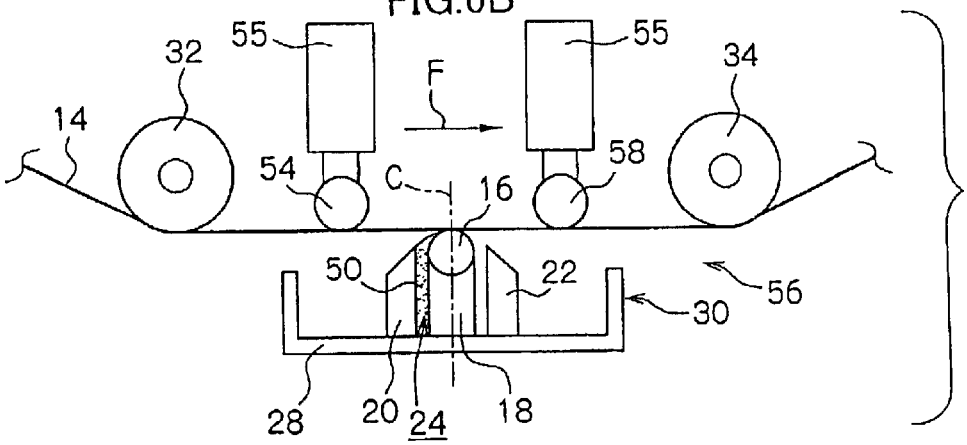
FIG. 6B is a front view showing a schematic structure of the bar coating apparatus when coating, according to the second embodiment of the invention.
Figure 6C:
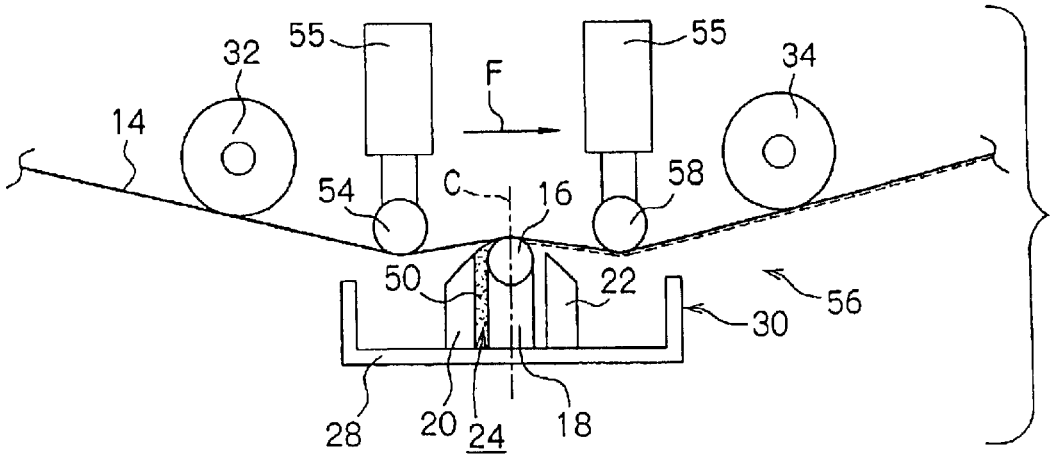
FIG. 6C is a front view showing a schematic structure of the bar coating apparatus when coating, according to the second embodiment of the invention.

FIGS. 6A, 6B and 6C show a bar coating apparatus 56 of the second embodiment. In the bar coating apparatus 56, in addition to a pressing roll 54 that is similar to the first embodiment, a pressing roll 58 is also arranged.

As is clear from FIGS. 6A, 6B and 6C, the pressing roll 58 is arranged in a position that is symmetrical with the pressing roll 54 with respect to a center line C passing through centers of a coating bar 16 and a bearing member 18. Moreover, as with to the pressing roll 54, the pressing roll 58 is rotatably supported by a supporting device 55 so that the axial direction of the pressing roll 58 coincides with the width direction of the aluminum web 14. Furthermore, the pressing roll 58 is moveable in the same direction as the thickness direction of the aluminum web 14 (i.e., a vertical direction). As shown in FIG. 6A, when the coating device 30 is lowered down away from the aluminum web 14, both the pressing rolls 54 and 58 contact the aluminum web 14 only to an extent that the planarity of the aluminum web 14 between support rolls 32 and 34 are not impaired. The pressing rolls 54 and 58 rotate due to friction with the aluminum web 14 when the aluminum web 14 is conveyed.

The bar coating apparatus 56 of the second embodiment, having the above structure, exhibits the same effects as that of the bar coating apparatus 12 in the first embodiment. Namely, the positions of the pressing rolls 54 and 58 in the vertical direction are adjusted according to conditions such as the thickness of the aluminum web 14, and thus the length CL of the clearance C between the aluminum web 14 and the weir plate 20 is adjusted to be within a desirable range. Hence, the bead 52 is formed among the aluminum web 14, the weir plate 20 and the coating bar 16, and can be retained stably.

In the second embodiment, since the pressing roll 58 is also moved vertically downstream of the coating bar 16, particularly when there is a anxiety that, for example, the length CL of the clearance C changes due to the conveying state or the like of the aluminum web 14 on the downstream side of the coating bar 16, the bar coating apparatus 56 stabilizes the bead 50 and makes the coated surface quality of the aluminum web 14 fine.

A third embodiment of the present invention will now be described. Components that are substantially the same as components described in the previous embodiments are designated by the same reference numerals, and description thereof is omitted.

Figure 7A:
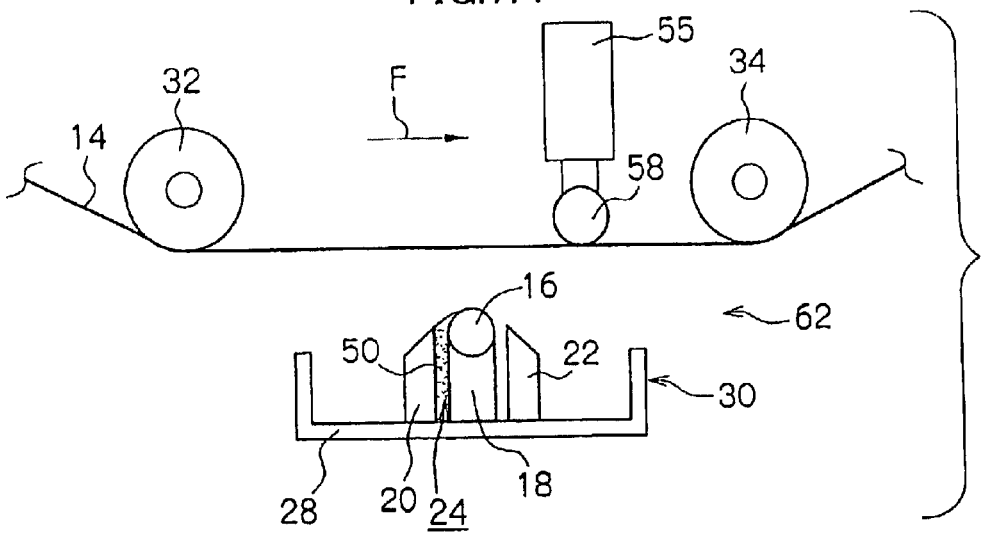
FIG. 7A is a front view showing a schematic structure of the bar coating apparatus when not coating, according to a third embodiment of the invention.
Figure 7B:
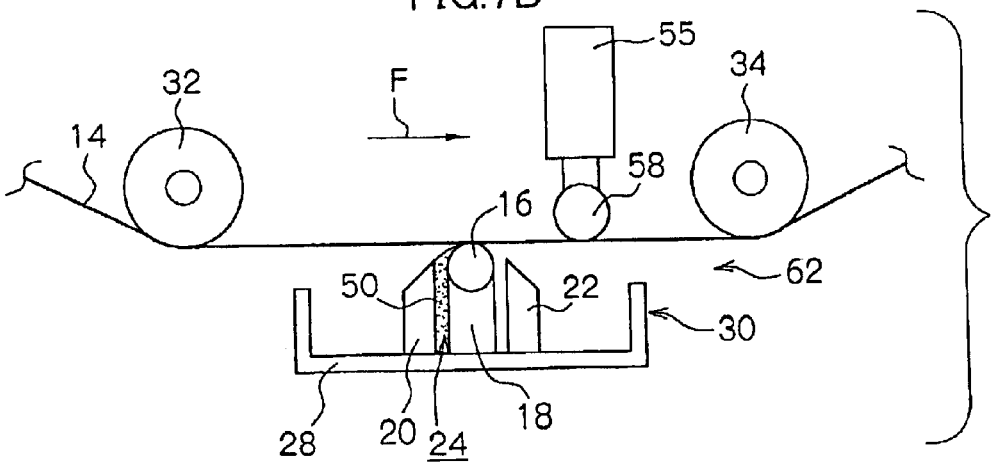
FIG. 7B is a front view showing a schematic structure of the bar coating apparatus when coating, according to the third embodiment of the invention.
Figure 7C:
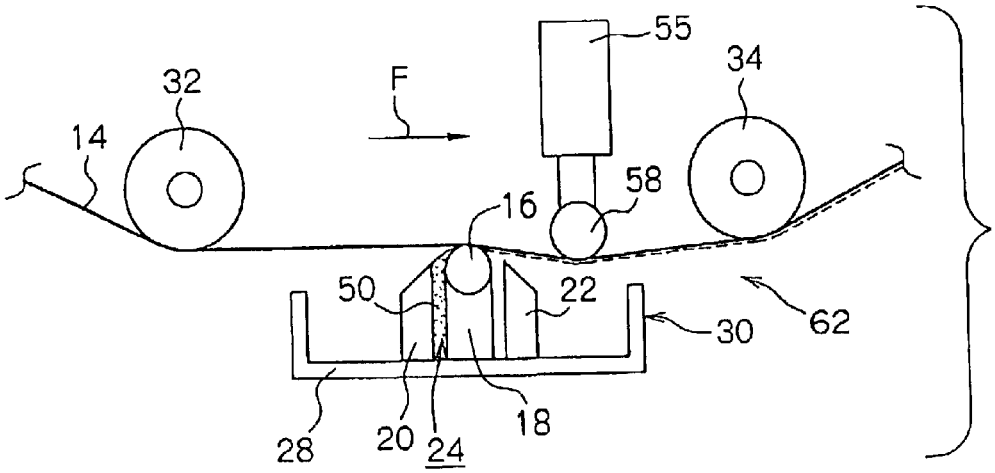
FIG. 7C is a front view showing a schematic structure of the bar coating apparatus when coating, according to the third embodiment of the invention.

FIG. 7 shows a bar coating apparatus 62 according to the third embodiment of the invention. In the bar coating apparatus 62, the pressing roll 54 is not provided, and only the pressing roll 58, which is similar to the pressing roll 58 of the second embodiment, is provided. The pressing roll 58 is supported by the supporting device 55 so as to be movable in the vertical direction.

The bar coating apparatus 62, having the structure described above, also exhibits the same effects as that of the bar coating apparatus 12 in the first embodiment. Namely, the vertical position of the pressing roll 58 is adjusted according to conditions such as the thickness of the aluminum web 14, so that the amount of deflection of the aluminum web 14 changes on the downstream side of the coating bar 16. Therefore, a deflection amount of the aluminum web 14 also changes on the upstream side of the coating bar 16, and the length CL of the clearance C between the aluminum web 14 and the weir plate 20 is adjusted. As a result, the bead 52 formed among the aluminum web 14, the weir plate 20 and the coating bar 16 is retained stably, and the coated surface quality of the aluminum web 14 can be fine.

As described above in the first through third embodiments of the invention, the vertical position of at least one of the pressing rolls 54 and 58 is changed according to various condition such as the thickness of the aluminum web 14, and the length CL of the clearance C is adjusted. This ensures that the coated surface quality of the aluminum web 14 can be uniform, even if the aluminum web 14 has an uneven thickness.

A fourth embodiment of the present invention will now be described. Components that are substantially the same as components described in the previous embodiments are designated by the same reference numerals, and description thereof is omitted.

Figure 8:
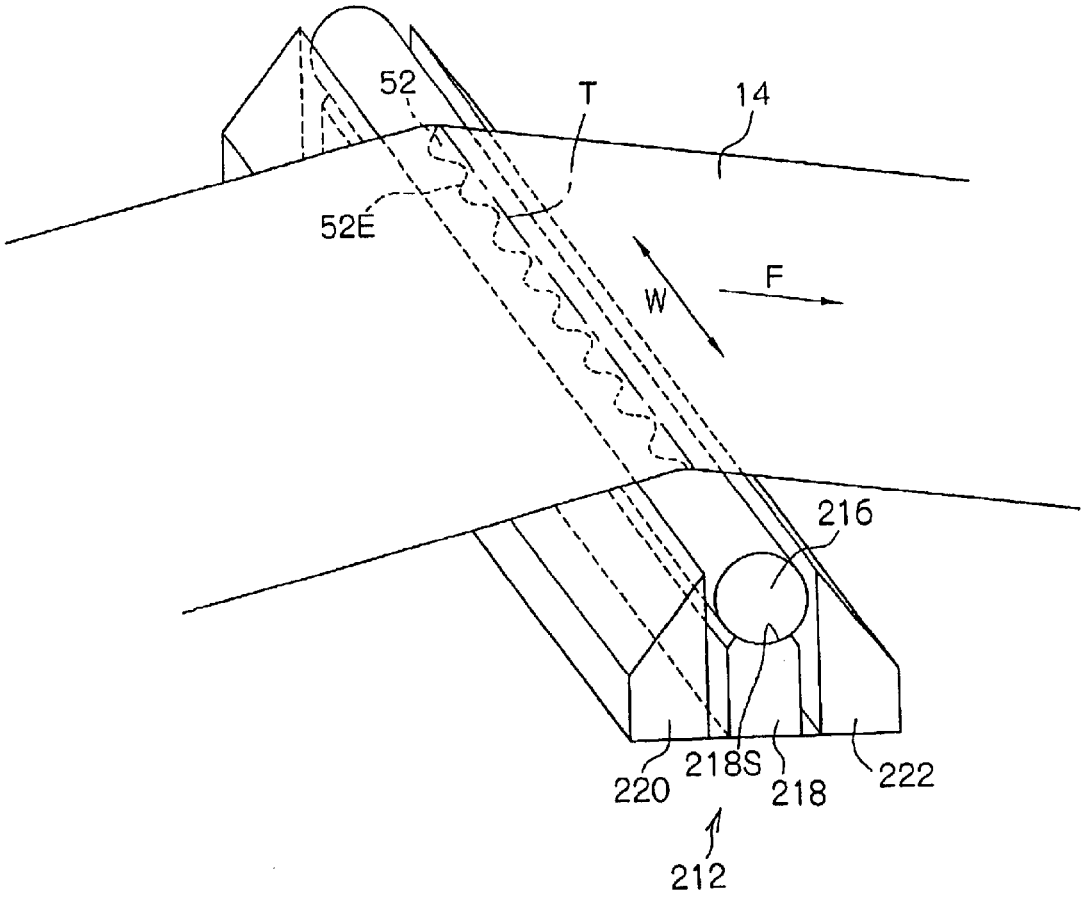
FIG. 8 is a perspective view showing a schematic structure of the bar coating apparatus according to a fourth embodiment of the invention.
Figure 9A:
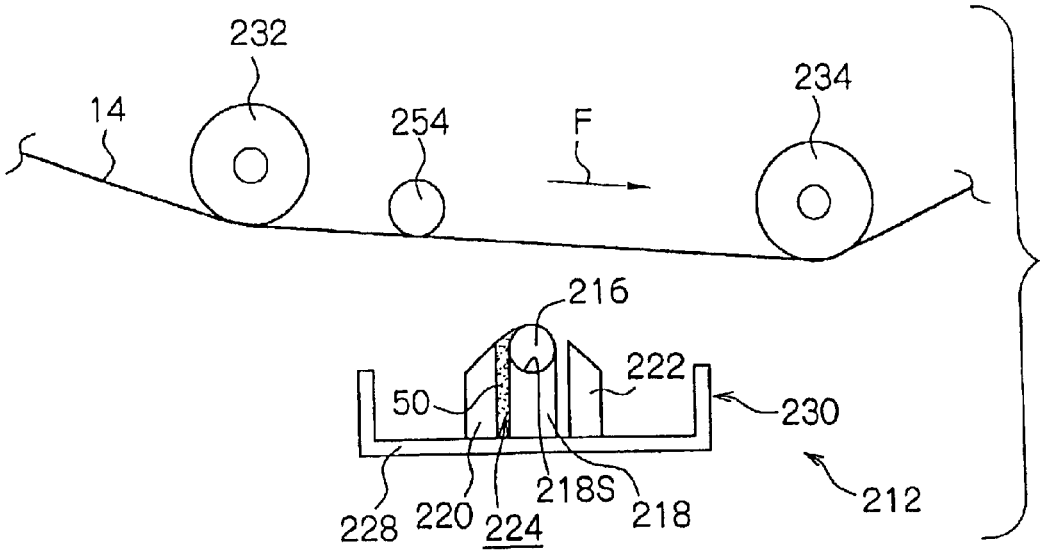
FIG. 9A is a front view showing a schematic structure of the bar coating apparatus when not coating, according to the fourth embodiment of the invention.
Figure 9B:
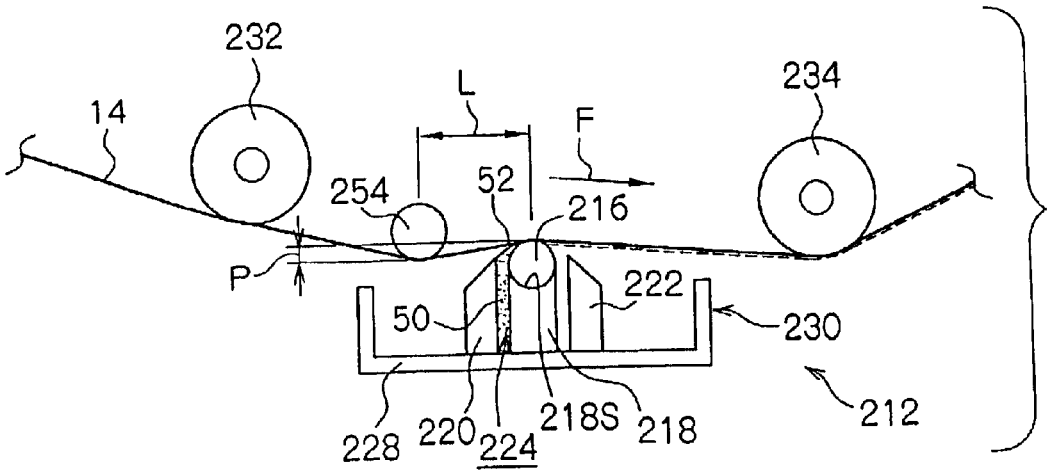
FIG. 9B is a front view showing a schematic structure of the bar coating apparatus when coating, according to the fourth embodiment of the invention.

FIGS. 8, 9A and 9B show a bar coating apparatus 212 according to the fourth embodiment. The bar coating apparatus 212 is incorporated into a manufacturing line of a planographic printing plate precursor. The bar coating apparatus 212 is used for applying a coating solution 50 (photosensitive solution or the like) to an aluminum web 14, which is a substrate of the planographic printing plate precursor. The aluminum web 14 is conveyed in the longitudinal direction thereof at a predetermined conveyance speed by a conveyance device (not shown).

The bar coating apparatus 212 has a coating bar 216 which is arranged so as to come in contact with the aluminum web 14 from below. The coating bar 216 is formed into an approximately columnar shape (or approximately cylindrical shape), and is supported by a bearing member 18 so that its longitudinal direction coincides with the width direction of the aluminum web 14.

An upper surface of the bearing member 218 is a supporting surface 218S which is formed into an arc shape along an outer peripheral surface of the coating bar 216. The coating bar 216 contacts the supporting surface 218S and is rotatably supported thereon.

Weir plates 220 and 222 are arranged on upstream and downstream sides of the bearing member 218, respectively. Predetermined clearances are provided between the weir plates 220, 222 and the bearing member 218, respectively. The clearance between the weir plate 220 on the upstream side and the bearing member 218 serves as a coating solution supply path 224. A coating solution 50, which is fed from a coating solution supply device (not shown), passes through the coating solution supply path 224 and is successively raised by rotation of the coating bar 216 so as to be transferred to the aluminum web 14. Further, upstream of the portion at which the aluminum web 14 and the coating bar 216 contact, a bead 52 of the coating solution 50 is formed among the aluminum web 14, the weir plate 220, and the coating bar 216.

As shown in FIGS. 9A and 9B, the bearing member 218 and the weir plates 220, 222 are held integrally by a holder 228 so as to compose a coating device 230. Moreover, support rolls 232 and 234 which come in contact with the aluminum web 14 from the opposite side to the coating device 230 (i.e., from above the aluminum web 14) are disposed both upstream and downstream of the coating device 230, respectively (in FIG. 8, the support rolls 232 and 234 are not shown). When the support rolls 232 and 234 press down upon the aluminum web 14 from above, a predetermined tension is being applied to the aluminum web 14, and thus, the aluminum web 14 can be brought into contact with the coating bar 216.

When an elevating device (not shown) is driven, the bearing member 218 and the weir plates 220, 222 composing the coating device 230 can be integrally moved vertically. As shown in FIG. 9A, in a state where the coating device 230 is lowered down away from the aluminum web 14, the coating bar 216 does not come in contact with the aluminum web 14. Therefore, the coating solution 50 is not applied to the aluminum web 14. However, as shown in FIG. 9B, when the coating device 230 is lifted up, the coating bar 216 is brought into contact with the aluminum web 14 so that the coating solution 50 can be applied. Moreover, when the coating device 230 is moved up or down while contact is being maintained, a desirable contact pressure is obtained, so that the coating can be carried out in accordance with the different types of the aluminum webs 14 and the coating solutions 50.

Figure 10:
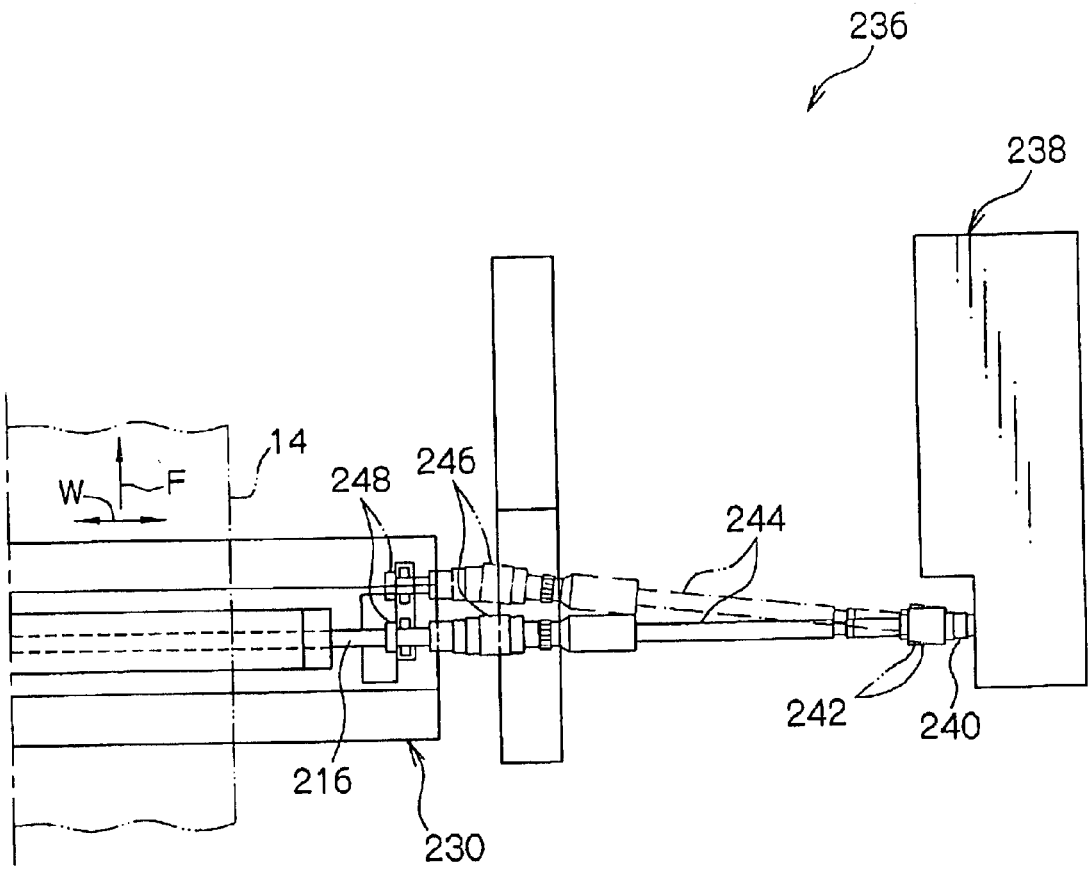
FIG. 10 is a plan view showing the rotation drive of the bar coating apparatus according to the fourth embodiment of the invention.
Figure 11:
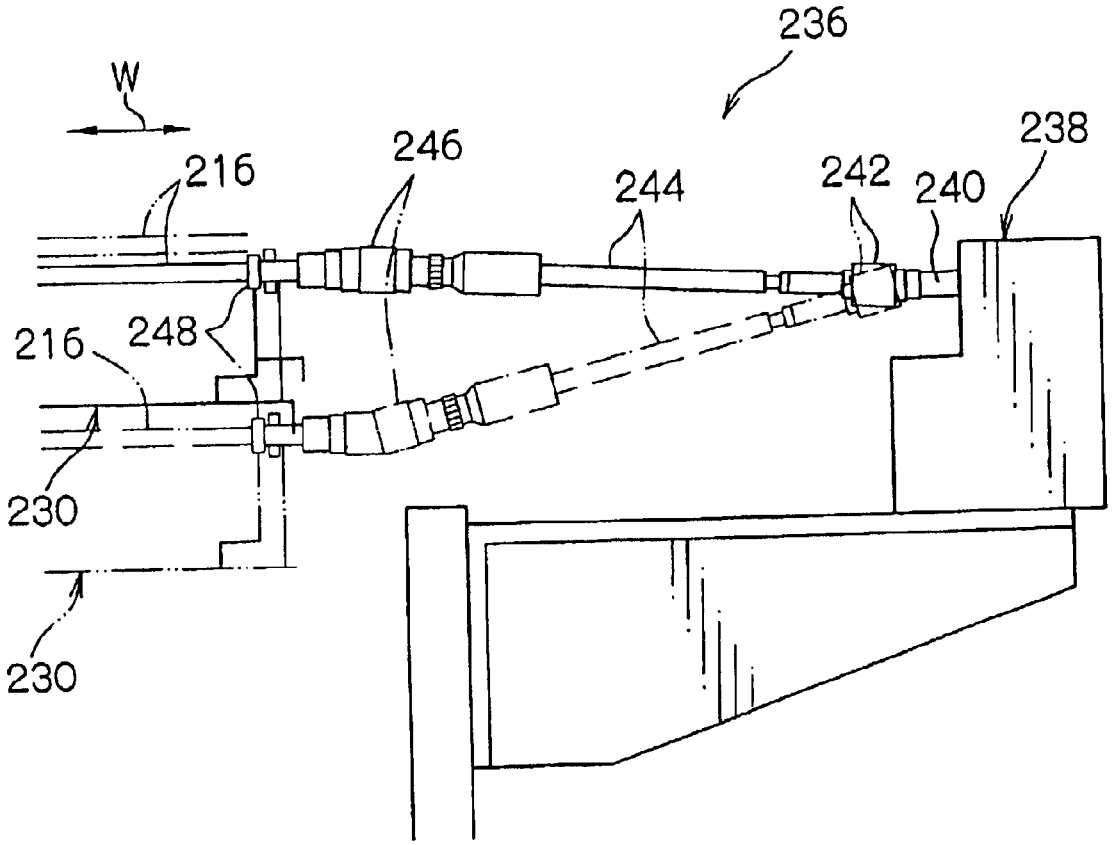
FIG. 11 is a side view showing the rotation drive of the bar coating apparatus according to the fourth embodiment of the invention.

FIGS. 10 and 11 show schematic structures of a rotation drive 236 for driving the rotation of the coating bar 216.

The rotation drive 236 is structured to include a motor and a reduction device and the like, and has a drive source 238 for generating a rotational driving force at a predetermined torque and at a predetermined angular velocity. An output shaft 240 of the drive source 238 is connected to a shaft 244 via a first universal joint 242. Further, the shaft 244 is connected to a switching member 248 via a second universal joint 246. The switching member 248 moves between a transmission position where the switching member 248 is connected to the coating bar 216 to enable to transmit rotational driving force thereto (a position shown by a solid line in FIG. 10) and a non-transmission position, where the connection with the coating bar 216 is released and the rotational driving force is not transmitted (a position shown by the two-dot chain line in FIG. 10).

In addition, since the drive source 238 is connected to the coating bar 216 via the two universal joints 242 and 246, the rotational driving force of the drive source 238 can be transmitted to the coating bar 216 while an angle between the output shaft 240 of the drive source 238 and the coating bar 216 is being always kept constant. For example, in the case where the coating device 230 is slightly moved vertically or, as shown by the two-dot chain line in FIG. 11, the coating device 230 is lowered down so that the coating bar 216 is separated from the aluminum web 14, the output shaft 240 of the drive source 238 is parallel with the coating bar 216, and the coating bar 216 receives the rotational driving force of the drive source 238 so as to rotate.

In the bar coating apparatus 212 of the present embodiment, the coating bar 216 can be actively rotated by the rotational driving force from the drive source 238 so that a peripheral speed of the coating bar 216 differs from a peripheral speed corresponding to the conveyance speed of the aluminum web 14.

A pressing roll 254, which comes in contact with the aluminum web 14 from above the aluminum web 14, namely, the opposite side to the coating bar 216, is disposed between the support roll 232 and the coating bar 216. The pressing roll 254 is rotatably supported by a bearing member (not shown) so that the axial direction thereof coincides with the width direction of the aluminum web 14. As shown in FIG. 9A, the pressing roll 254 contacts the aluminum web 14 to an extent that planarity of the aluminum web 14 between the support rolls 232 and 234 is not impaired, when the coating device 230 is in the lowered position. The pressing roll 254 rotates due to friction with the aluminum web 14 when the aluminum web 14 is conveyed.

In contrast, as shown in FIG. 9B, when the coating device 230 is lifted up and the aluminum web 14 is coated with the coating solution 50, the aluminum web 14 is pressed by the support rolls 232 and 234 from above and further pressed by the pressing roll 254 as it is pushed by the coating bar 216 from below. Thus, the aluminum web 14 is conveyed with it being bent slightly upwards and downwards. The aluminum web 14 is conveyed by the pressing roll 254 from the opposite side to the coating bar 216 while the movement in the vertical direction (thickness direction) is being limited. Therefore, the aluminum web 14 is prevented from flapping during conveyance.

The position of the pressing roll 254 in the conveyance direction is not particularly limited as long as the flapping of the aluminum web 14 during conveyance can be prevented. Moreover, also in the present embodiment, it is preferable that a pressing position L shown in FIG. 9B is within the range of 10 to 150 mm, and even more preferable within the range of 15 to 60 mm.

The vertical position of the pressing roll 254 is also not limited as long as the flapping of the aluminum web 14 during conveyance can be prevented. Moreover, in the present embodiment, it is preferable that a forcing amount P shown in FIG. 9B is within the range of 1 to 30 mm. The forcing amount P can be set to a desirable value by previously setting the position of the pressing roll 254 suitably, and also the desirable value can be obtained by adjusting the amount of lift of the coating device 230.

Next, a method of applying the coating solution 50 to the aluminum web 14 using the bar coating apparatus 212 of the present embodiment and a function of the bar coating apparatus 212 will now be described.

When the coating solution 50 is applied to the aluminum web 14, the aluminum web 14 is conveyed at a constant conveyance speed by the conveyance device (not shown).

In addition, the coating device 230 is lifted up as shown in FIG. 9B, and the coating bar 216 is brought into contact with the aluminum web 14, and the coating solution 50 is supplied from the coating solution supply device (not shown). In the bar coating apparatus 212 of the present embodiment, the aluminum web 14 is pressed by the pressing roll 254 from the opposite side of the coating bar 216, and thus the movement of the aluminum web 14 during conveyance in the thickness direction is limited. Namely, since the flapping of the aluminum web 14 during conveyance is prevented, the aluminum web 14 contacts with the coating bar 216 and the contacting situation is constantly maintained. Further, the vertical movement of the aluminum web 14 with respect to the weir plate 220 is also limited to a constant range. As a result, the bead 52 arranged among the aluminum web 14, the weir plate 220 and the coating bar 216 becomes stable. For this reason, coating streak or the like due to disturbance of the bead does not occur in the coated coating solution 50, and an uniformly coated surface quality can be obtained on the aluminum web 14. Particularly when the conveyance speed of the aluminum web 14 is increased, there is a strong tendency for the aluminum web 14 to flap vertically, but in the bar coating apparatus 212 of the present embodiment, since the flapping of the aluminum web 14 is prevented securely, a uniform coated surface quality can be obtained.

In addition, in the bar coating apparatus 212 of the present embodiment, the switching member 248 is moved to the transmission position of the driving force when coating, as shown by a solid line in FIG. 10. The rotational driving force of the drive source 238 can be transmitted to the coating bar 216. As a result, the coating bar 216 is actively rotated at a peripheral speed, which differs from a peripheral speed corresponding to the conveyance speed of the aluminum web 14.

Generally, when the bead 52 is arranged among the aluminum web 14, the weir plate 220 and the coating bar 216, and the bead 52 is viewed from a contact portion T between the aluminum web 14 and the coating bar 216 (shown by the chain line in FIG. 8), in the case where an edge portion 52E of the bead 52 draws a periodic curved line in the width direction, the coated surface quality becomes fine. Particularly when the edge portion 52E has a sine curve shape or a shape close to a sine curve, the coated surface quality becomes even better.

As mentioned above, the peripheral speed of the coating bar 216 is set to be different from the peripheral speed corresponding to the conveyance speed of the aluminum web 14. As a result, the edge portion 52E of the bead 52 has a shape similar to the sine curve, and the bead 52 is maintained stably. Therefore, streak coating of the coating solution 50 or the like due to disturbance of the bead does not occur, and a uniform coated surface quality can be obtained.

Particularly in cases where the coating solution 50 having a high viscosity is used, or in cases where the conveyance speed of the aluminum web 14 is increased, the edge portion 52E of the bead 52 has a shape similar to a sine curve, and the bead 52 can be maintained stably. Therefore, the coated surface quality can be uniform. From this viewpoint, the rotation speed of the coating bar 216 is not particularly limited as long as it is a peripheral speed different from the peripheral speed corresponding to the conveyance speed of the aluminum web 14.

Needless to say, there are occasions when it is preferable that the coating bar 216 is rotated (driven) by friction with the aluminum web 14 similarly to the conventional structure, depending on the conveyance speed of the aluminum web 14, the viscosity of the coating solution 50 and the other conditions. In such instances, the rotational driving force of the drive source 238 can be easily prevented from being transmitted to the coating bar 216 just by moving the switching member 248 to the non-transmission position of the driving force, as shown by the two-dot chain line in FIG. 10.

A fifth embodiment of the invention will now be described. Components that are substantially the same as components described in the previous embodiments are designated by the same reference numerals, and description thereof is omitted.

Figure 12A:
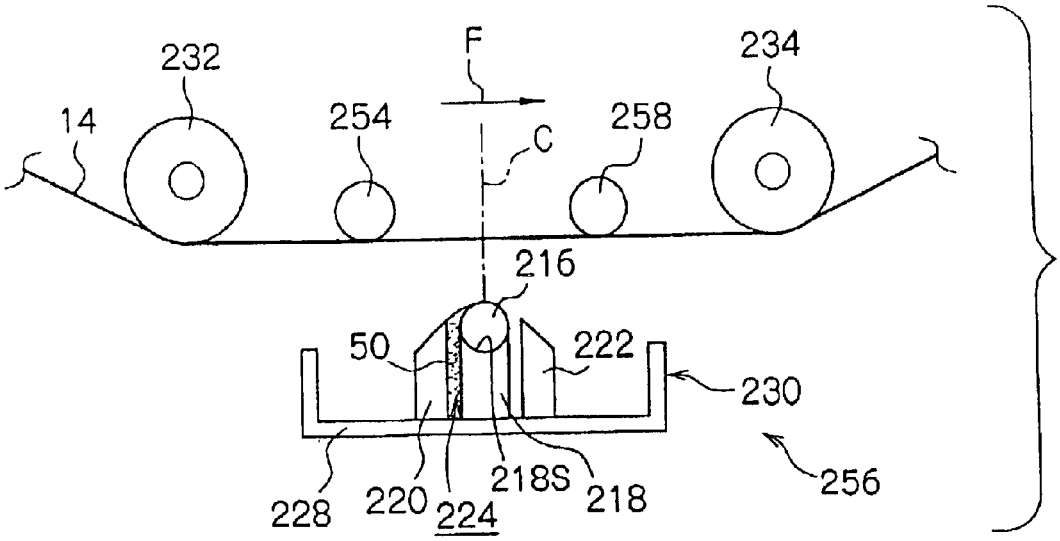
FIG. 12A is a front view showing a schematic structure of the bar coating apparatus when not coating, according to a fifth embodiment of the invention.
Figure 12B:
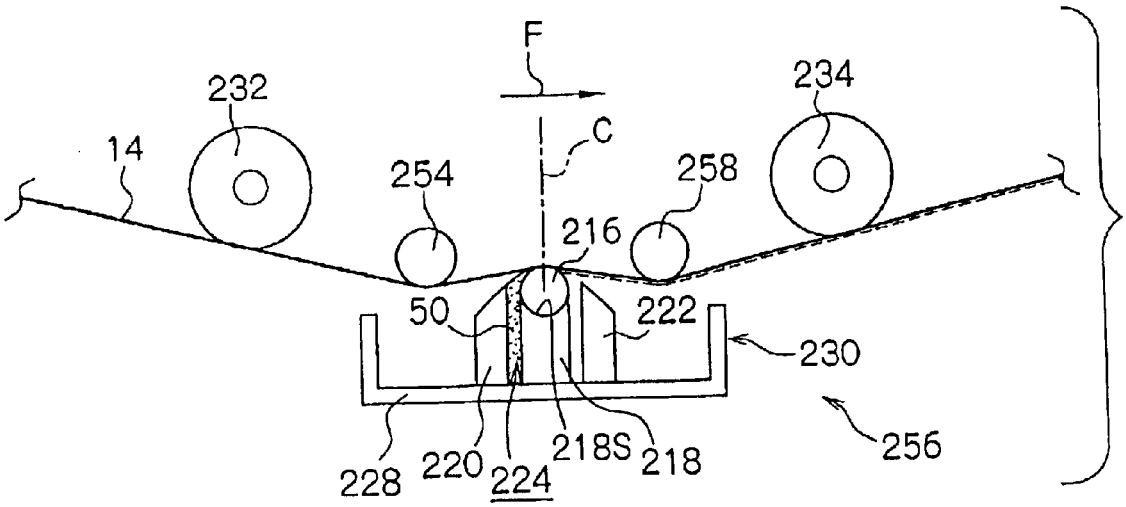
FIG. 12B is a front view showing a schematic structure of the bar coating apparatus when coating, according to the fifth embodiment of the invention.

FIGS. 12A and 12B show a bar coating apparatus 256 of the fifth embodiment. In the bar coating apparatus 256, in addition to a pressing roll 254 that is similar to the fourth embodiment, a pressing roll 258 is also arranged.

As is clear from FIGS. 12A and 12B, the pressing roll 258 is arranged in a position that is symmetrical with the pressing roll 254 with respect to a center line C passing through centers of the coating bar 216 and the bearing member 218. Moreover, as with the pressing roll 254, the pressing roll 258 is rotatably supported by a supporting member (not shown) so that its axial direction coincides with the width direction of the aluminum web 14. As shown in FIG. 12A, when the coating device 230 is lowered down, the pressing roll 258 contacts the aluminum web 14 only to the extent that the planarity of the aluminum web 14 between the support rolls 232 and 234 are not impaired. The pressing rolls 254 and 258 rotate due to friction with the aluminum web 14 when the aluminum web 14 is conveyed.

The bar coating apparatus 256 of the second embodiment, having the above structure, exhibits the same effects as that of the bar coating apparatus 212 in the fourth embodiment. Namely, the flapping of the aluminum web 14 is prevented, so that the bead 52 is stabilized and a good-coated surface quality can be obtained.

Further, the pressing roll 258 also contacts the aluminum web 14 on the downstream side of the coating bar 216 so that the flapping is prevented. Especially, in such cases where there is a concern that the bead 52 could become unstable due to the flapping of the aluminum web 14 on the downstream side of the coating bar 216, the bead 52 is further stabilized so that good coated surface quality of the aluminum web 14 can be obtained in the bar coating apparatus 256.

A sixth embodiment of the present invention will now be described. Components that are substantially the same as components described in the previous embodiments are designated by the same reference numerals, and description thereof is omitted.

Figure 13A:
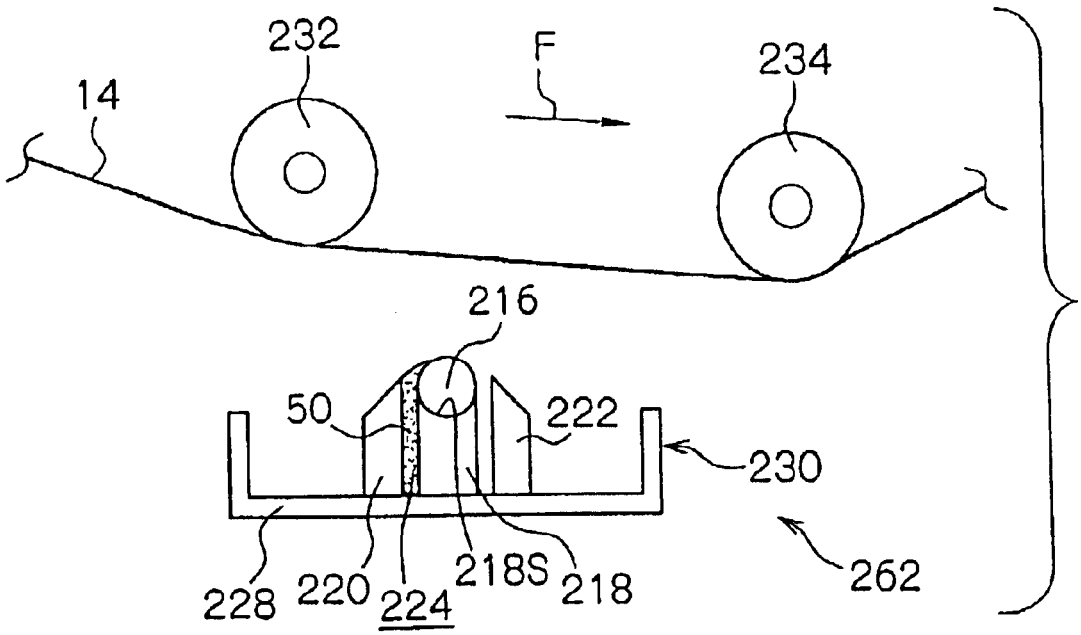
FIG. 13A is a front view showing a schematic structure of the bar coating apparatus when not coating, according to a sixth embodiment of the invention.
Figure 13B:
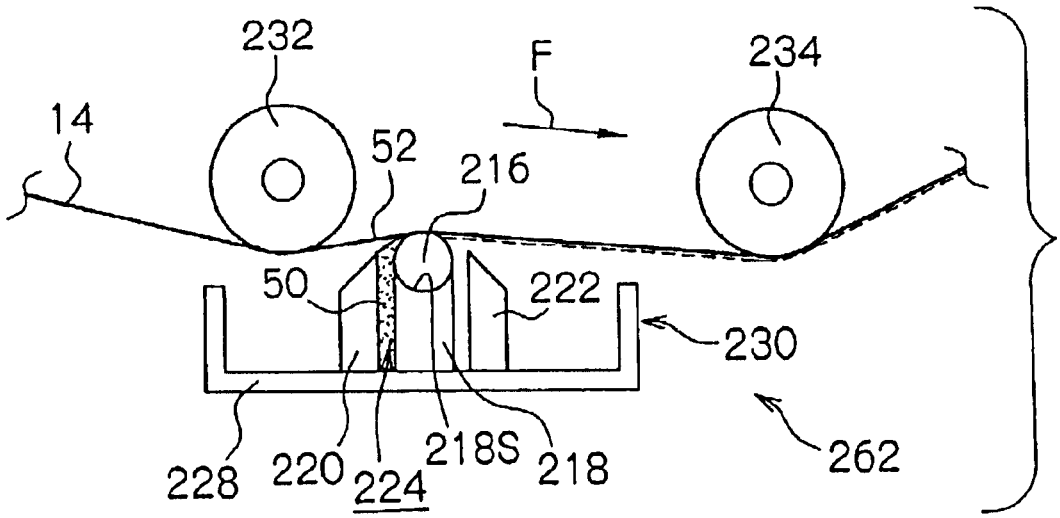
FIG. 13B is a front view showing a schematic structure of the bar coating apparatus when coating, according to the sixth embodiment of the invention.

FIGS. 13A and 13B show a bar coating apparatus 262 of the sixth embodiment. In the bar coating apparatus 262 of the sixth embodiment, the pressing rolls 254 and 258 of the fourth and fifth embodiments are not provided. However, the support roll 232 on upstream from the coating bar 216 is provided in approximately the same position as the position of the pressing roll 254 is provided in the fourth embodiment.

Therefore, in the bar coating apparatus 262 of the sixth embodiment, the support roll 232 also essentially serves as the pressing roll 254 of the fourth embodiment. Namely, since the aluminum web 14 is pressed upon by the support roll 232 from the opposite side to the coating bar 216, the flapping of the aluminum web 14 during conveyance is prevented. For this reason, the bead 52 formed among the aluminum web 14, the weir plate 220 and the coating bar 216 is stabilized, so that a uniform coated surface quality can be obtained on the aluminum web 14.

In addition, in the bar coating apparatus 262, as mentioned above, the support roll 232 also serves as the pressing roll 254, and thus the number of parts is less than in the bar coating apparatus 212 of the fourth embodiment. Therefore, the structure of the bar coating apparatus of the present embodiment is simplified.

As described above, in the fourth through sixth embodiments of the invention, since the flapping of the aluminum web 14 during conveyance is prevented, the bead 52 is stabilized. Therefore, coating streak or the like due to disturbance of the bead does not occur in the coated coating solution 50 and a uniform coated surface quality can be obtained on the aluminum web 14. Particularly when the conveyance speed of the aluminum web 14 is increased, the flapping of the aluminum web 14 is securely prevented so that a coated surface quality can be maintained uniformly in the bar coating apparatuses 212, 256 and 262 of the respective embodiments.

A seventh embodiment of the present invention will now be described. Components that are substantially the same as components described in the previous embodiments are designated by the same reference numerals, and description thereof is omitted.

Figure 14:
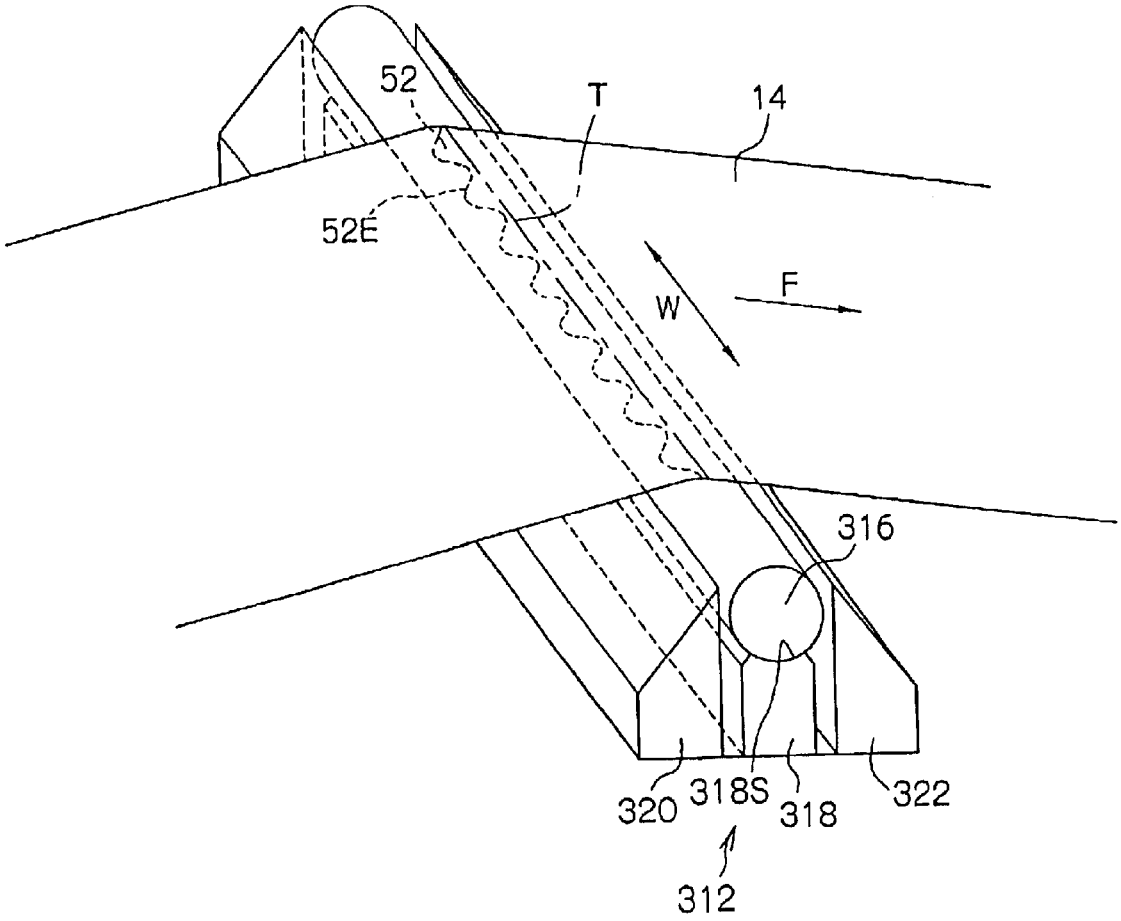
FIG. 14 is a perspective view showing a schematic structure of the bar coating apparatus according to a seventh embodiment of the invention.
Figure 15A:
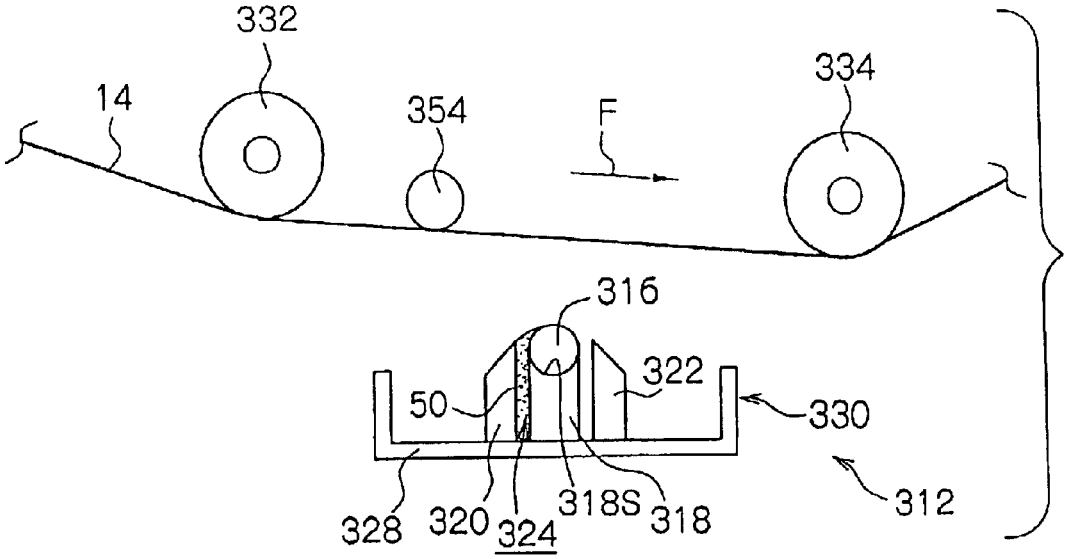
FIG. 15A is a front view showing a schematic structure of the bar coating apparatus when not coating, according to the seventh embodiment of the invention.
Figure 15B:
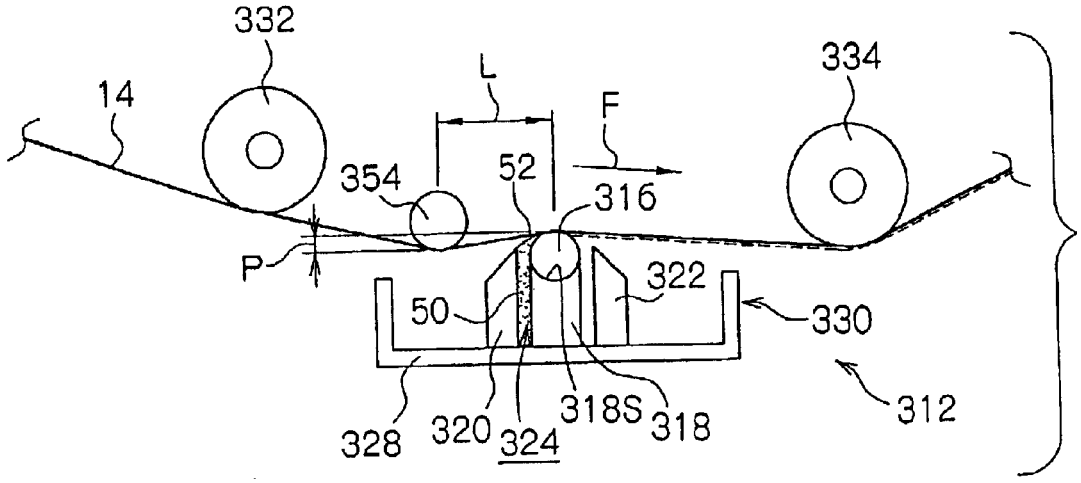
FIG. 15B is a front view showing a schematic structure of the bar coating apparatus when coating, according to the seventh embodiment of the invention.

FIGS. 14, 15A and 15B show a bar coating apparatus 312 according to the seventh embodiment of the present invention. The bar coating apparatus 312 is incorporated into a manufacturing line of a planographic printing plate precursor. The bar coating apparatus 312 is used for applying a coating solution 50 (photosensitive solution or the like) to an aluminum web 14, which is a substrate of the planographic printing plate precursor. The aluminum web 14 is conveyed in the longitudinal direction thereof at a predetermined conveyance speed by a conveyance device (not shown).

The bar coating apparatus 312 has a coating bar 316 which is arranged so as to come in contact with the aluminum web 14 from below. The coating bar 316 is formed into an approximately columnar shape (or approximately cylindrical shape), and is supported by a bearing member 318 so that its longitudinal direction coincides with the width direction of the aluminum web 14.

An upper surface of the bearing member 318 is a supporting surface 18S which is formed into an arc shape along an outer peripheral surface of the coating bar 316. The coating bar 316 contacts the supporting surface 18S and is rotatably supported thereon.

Weir plates 320 and 322 are arranged on upstream and downstream sides of the bearing member 318, respectively. Predetermined clearances are provided between the weir plates 320, 322 and the bearing member 318, respectively. The clearance between the weir plate 320 on the upstream side and the bearing member 318 especially serves as a coating solution supply path 324. A coating solution 50, which is fed from a coating solution supply device (not shown), passes through the coating solution supply path 324 and is successively raised by rotation of the coating bar 316 so as to be transferred to the aluminum web 14. Further, upstream of the portion at which the aluminum web 14 and the coating bar 316 contact, a bead 52 of the coating solution 50 is formed among the aluminum web 14, the weir plate 320, and the coating bar 316.

As shown in FIGS. 15A and 15B, the bearing member 318 and the weir plates 320, 322 are held integrally by a holder 28 so as to compose a coating device 330. Moreover, support rolls 332 and 334 which come in contact with the aluminum web 14 from the opposite side to the coating device 330 (i.e., from above the aluminum web 14) are disposed both upstream and downstream of the coating device 30, respectively (in FIG. 14, the support rolls 332 and 334 are not shown). When the support rolls 332 and 334 press down upon the aluminum web 14 from above, a predetermined tension is being applied to the aluminum web 14, and thus, the aluminum web 14 can be brought into contact with the coating bar 316.

When an elevating device (not shown) is driven, the bearing member 318 and the weir plates 320, 322 composing the coating device 330 can be integrally moved vertically. As shown in FIG. 15A, in a state where the coating device 330 is lowered down away from the aluminum web 14, the coating bar 316 does not come in contact with the aluminum web 14. Therefore, the coating solution 50 is not applied to the aluminum web 14. However, as shown in FIG. 15B, by lifting up the coating device 330, the coating bar 316 is brought into contact with the aluminum web 14, and the aluminum web 14 can be coated with the coating solution 50. Moreover, when the coating device 330 is slightly moved vertically while contact between the coating bar 316 and the aluminum web 14 is being maintained, a length CL of the clearance C arranged between the weir plate 320 and the aluminum web 14 (see FIG. 18) can be maintained so as to have a predetermined value.

Figure 16:
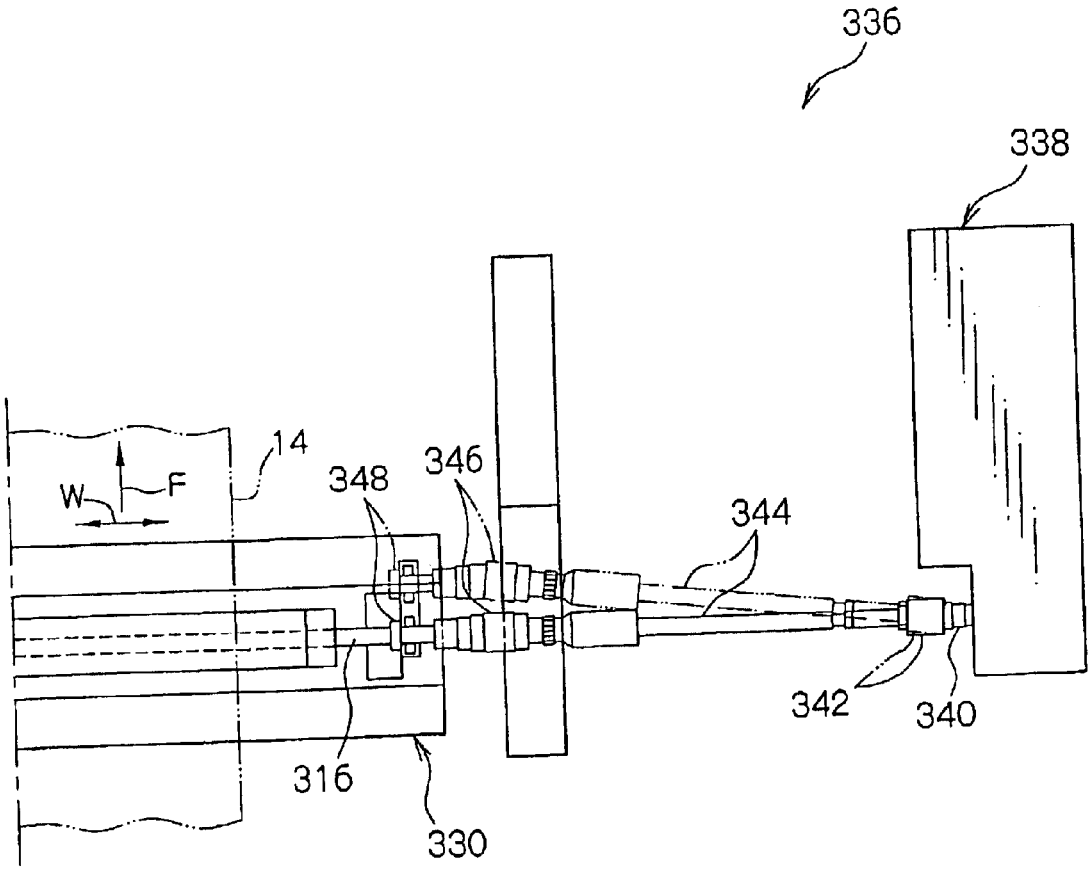
FIG. 16 is a plan view showing the rotation drive of the bar coating apparatus according to the seventh embodiment of the invention.
Figure 17:
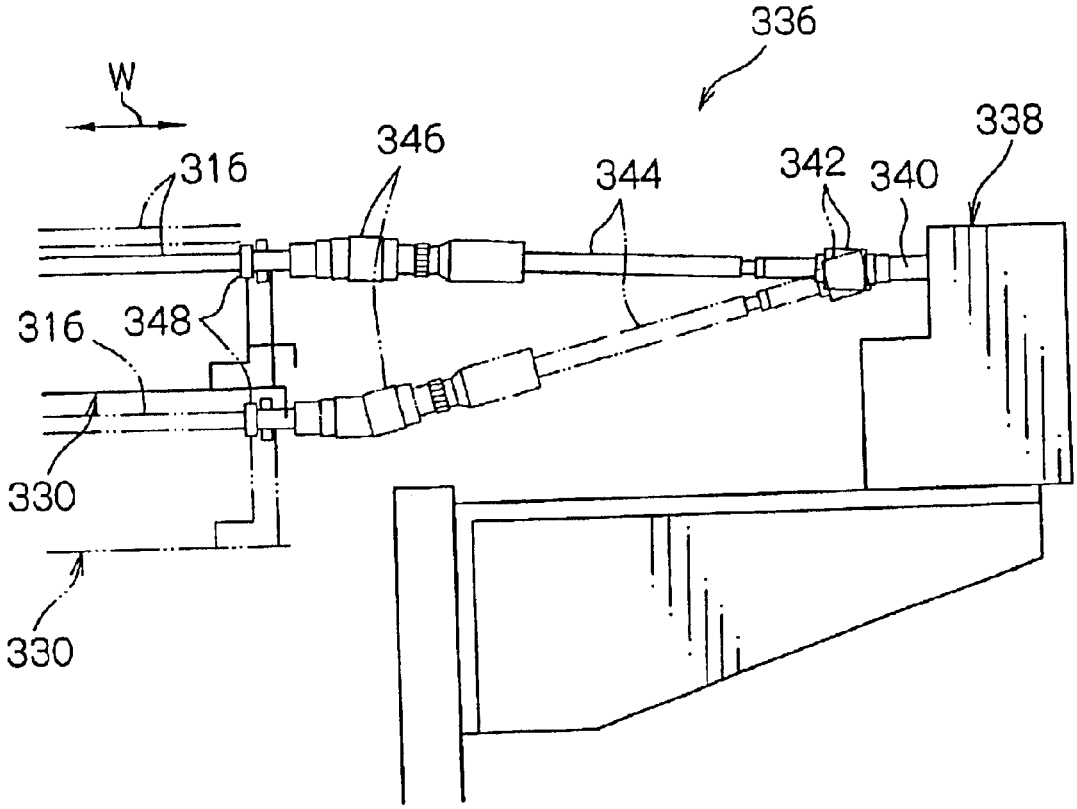
FIG. 17 is a side view showing the rotation drive of the bar coating apparatus according to the seventh embodiment of the invention.

FIGS. 16 and 17 show schematic structures of a rotation drive 336 for driving the rotation of the coating bar 316.

The rotation drive 336 is structured to include a motor and a reduction device and the like, and has a drive source 338 for generating a rotational driving force at a predetermined torque and at a predetermined angular velocity. An output shaft 340 of the drive source 338 is connected to a shaft 344 via a first universal joint 342. Further, the shaft 344 is connected to a switching member 348 via a second universal joint 346. The switching member 348 moves between a transmission position where the switching member 348 is connected to the coating bar 316 to enable to transmit rotational driving force thereto (a position shown by a solid line in FIG. 16) and a non-transmission position, where the connection with the coating bar 316 is released and the rotational driving force is not transmitted (a position shown by the two-dot chain line in FIG. 16).

In addition, since the drive source 338 is connected to the coating bar 316 via the two universal joints 342 and 346, the rotational driving force of the drive source 338 can be transmitted to the coating bar 316 while an angle between the output shaft 340 of the drive source 338 and the coating bar 316 is being always kept constant. For example, in the case where the coating device 330 is slightly moved vertically or, as shown by the two-dot chain line in FIG. 17, the coating device 330 is lowered down so that the coating bar 316 is separated from the aluminum web 14, the output shaft 340 of the drive source 338 is parallel with the coating bar 316, and the coating bar 316 receives the rotational driving force of the drive source 338 so as to rotate.

In the bar coating apparatus 312 of the present embodiment, the coating bar 316 can be actively rotated by the rotational driving force from the drive source 338 so that a peripheral speed of the coating bar 316 differs from a peripheral speed corresponding to the conveyance speed of the aluminum web 14.

A pressing roll 354, which comes in contact with the aluminum web 14 from above the aluminum web 14, namely, the opposite side to the coating bar 316, is disposed between the support roll 332 and the coating bar 316. The pressing roll 354 is rotatably supported by a bearing member (not shown) so that the axial direction thereof coincides with the width direction of the aluminum web 14. As shown in FIG. 15A, the pressing roll 354 contacts the aluminum web 14 to an extent that planarity of the aluminum web 14 between the support rolls 332 and 334 is not impaired, when the coating device 330 is in the lowered position. The pressing roll 354 rotates due to friction with the aluminum web 14 when the aluminum web 14 is conveyed.

In contrast, as shown in FIG. 15B, when the coating device 330 is lifted up and the aluminum web 14 is coated with the coating solution 50, the aluminum web 14 is pressed by the support rolls 332 and 334 from above and further pressed by the pressing roll 354 as it is pushed by the coating bar 316 from below. Thus, the aluminum web 14 is conveyed with it being bent slightly upwards and downwards. The aluminum web 14 is conveyed by the pressing roll 354 from the opposite side to the coating bar 316 while the movement in the vertical direction (thickness direction) is being limited. Therefore, the aluminum web 14 is prevented from flapping during conveyance.

The position of the pressing roll 354 in the conveyance direction is not particularly limited as long as the flapping of the aluminum web 14 during conveyance can be prevented. Moreover, also in the present embodiment, it is preferable that a pressing position L shown in FIG. 15B is within the range of 10 to 150 mm, and even more preferable within the range of 15 to 60 mm.

The vertical position of the pressing roll 354 is also not limited as long as the flapping of the aluminum web 14 during conveyance can be prevented. Moreover, in the present embodiment, it is preferable that a forcing amount P shown in FIG. 15B is within the range of 1 to 30 mm. The forcing amount P can be set to a desirable value by previously setting the position of the pressing roll 354 suitably, and also the desirable value can be obtained by adjusting the amount of lift of the coating device 330.

Next, a method of applying the coating solution 50 to the aluminum web 14 using the bar coating apparatus 312 of the present embodiment and a function of the bar coating apparatus 312 will now be described.

When the coating solution 50 is applied to the aluminum web 14, the aluminum web 14 is conveyed at a constant conveyance speed by the conveyance device (not shown).

In addition, as shown in FIG. 15B, the coating device 330 is lifted up and the coating bar 316 is brought into contact with the aluminum web 14, and the coating solution 50 is supplied from the coating solution supply device (not shown).

Figure 18:
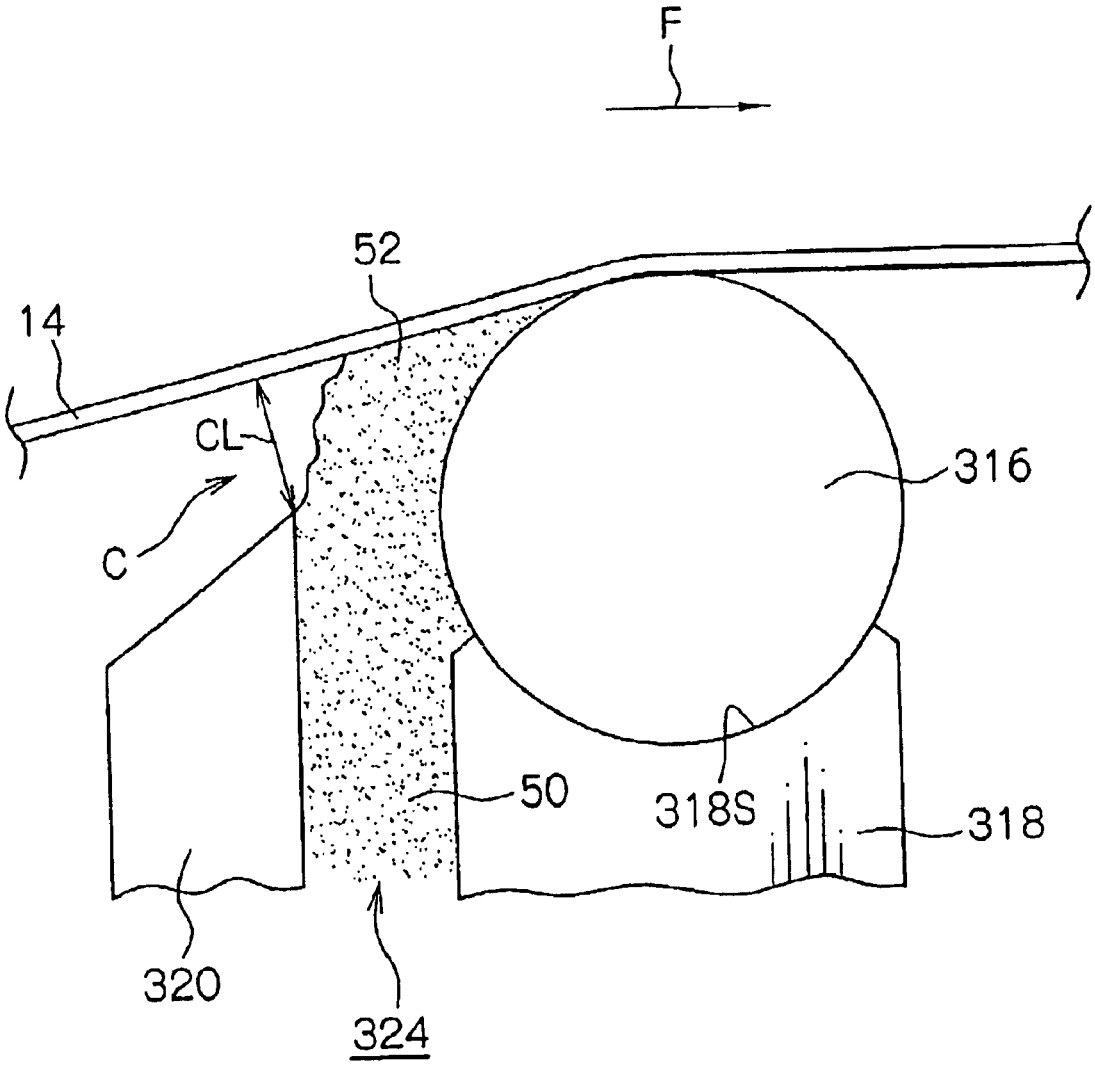
FIG. 18 is an explanatory diagram illustrating a clearance between an aluminum web and a weir plate in the bar coating apparatus according to the seventh embodiment of the invention.

At this time, in the bar coating apparatus 312 of the present embodiment, when the coating device 330 is moved vertically, the length CL of the clearance C formed between the weir plate 320 and the aluminum web 14 is adjusted so as to have a predetermined value, and even when the aluminum web 14 is conveyed, the set value can be maintained as shown in FIG. 18. Generally, when the length CL of the clearance C is large, so-called entrained air is trapped in the solution at the time of coating, and the bead 52 becomes unstable. In cases where the conveyance speed of the aluminum web 14 is increased, the entrained air is especially easily trapped in the solution, and the bead 52 becomes even more unstable. In the present embodiment, the length CL of the clearance C is set to no more than an upper limit value at which the trapping of the entrained air is reduced (preferably, entrained air is not generated), so that the coating solution 50 can be applied. For this reason, even when the conveyance speed of the aluminum web 14 is increased, the bead 52 is stabilized, so that a uniform coated surface quality can be obtained.

In the bar coating apparatus 312 of the present embodiment, the aluminum web 14 is pressed by the pressing roll 354 from the opposite side of the coating bar 316, and thus the movement of the aluminum web 14 during conveyance in the thickness direction is limited. Namely, since the flapping of the aluminum web 14 during conveyance is prevented, the aluminum web 14 contacts with the coating bar 316 and the contacting situation is constantly maintained. Further, the vertical movement of the aluminum web 14 with respect to the weir plate 320 is also limited to a constant range. As a result, the bead 52 arranged among the aluminum web 14, the weir plate 320 and the coating bar 316 becomes stable. For this reason, coating streak or the like due to disturbance of the bead does not occur in the coated coating solution 50, and an uniformly coated surface quality can be obtained on the aluminum web 14.

A supporting device, which supports the pressing roll 354 and allows vertical movement thereof, may be provided. As a result, the length CL of the clearance C may be maintained in a desirable value by using the supporting device to move the pressing roll 354 vertically in place of the vertical movement of the coating device 330 or using both the vertical movement of the coating device and the pressing roll 354. Further, it is not necessary for the pressing member to have the above-mentioned roll shape (columnar or cylindrical shape), and it may be a bar-shaped member or a plate member. However, in the case of the roll-shaped member, it is preferable that the diameter thereof is within the range of $\phi$10 to $\phi$200 mm from a viewpoint of the planarity of the aluminum web 14 (supporting body) being secured or prevention of slip at the time of conveyance.

Further, in the bar coating apparatus 312 of the present embodiment, the switching member 348 is moved to the transmission position of the driving force when coating, as shown by a solid line in FIG. 16. The rotational driving force of the drive source 338 can be transmitted to the coating bar 316. As a result, the coating bar 316 is actively rotated at a peripheral speed, which differs from a peripheral speed corresponding to the conveyance speed of the aluminum web 14.

Generally, when the bead 52 is arranged among the aluminum web 14, the weir plate 320 and the coating bar 316, and the bead 52 is viewed from a contact portion T between the aluminum web 14 and the coating bar 316 (shown by the chain line in FIG. 14), in the case where an edge portion 52E of the bead 52 draws a periodic curved line in the width direction, the coated surface quality becomes fine. Particularly when the edge portion 52E has a sine curve shape or a shape close to a sine curve, the coated surface quality becomes even better.

As mentioned above, the peripheral speed of the coating bar 316 is set to be different from the peripheral speed corresponding to the conveyance speed of the aluminum web 14. As a result, the edge portion 52E of the bead 52 has a shape similar to the sine curve, and the bead 52 is maintained stably. Therefore, streak coating of the coating solution 50 or the like due to disturbance of the bead does not occur, and a uniform coated surface quality can be obtained.

Needless to say, there are occasions when it is preferable that the coating bar 316 is rotated (driven) by friction with the aluminum web 14 similarly to the conventional structure, depending on the conveyance speed of the aluminum web 14, the viscosity of the coating solution 50 and the other conditions. In such instances, the rotational driving force of the drive source 338 can be easily prevented from being transmitted to the coating bar 316 just by moving the switching member 348 to the non-transmission position of the driving force, as shown by the two-dot chain line in FIG. 16.

An eighth embodiment of the present invention will now be described. Components that are substantially the same as components described in the previous embodiments are designated by the same reference numerals, and description thereof is omitted.

Figure 19:
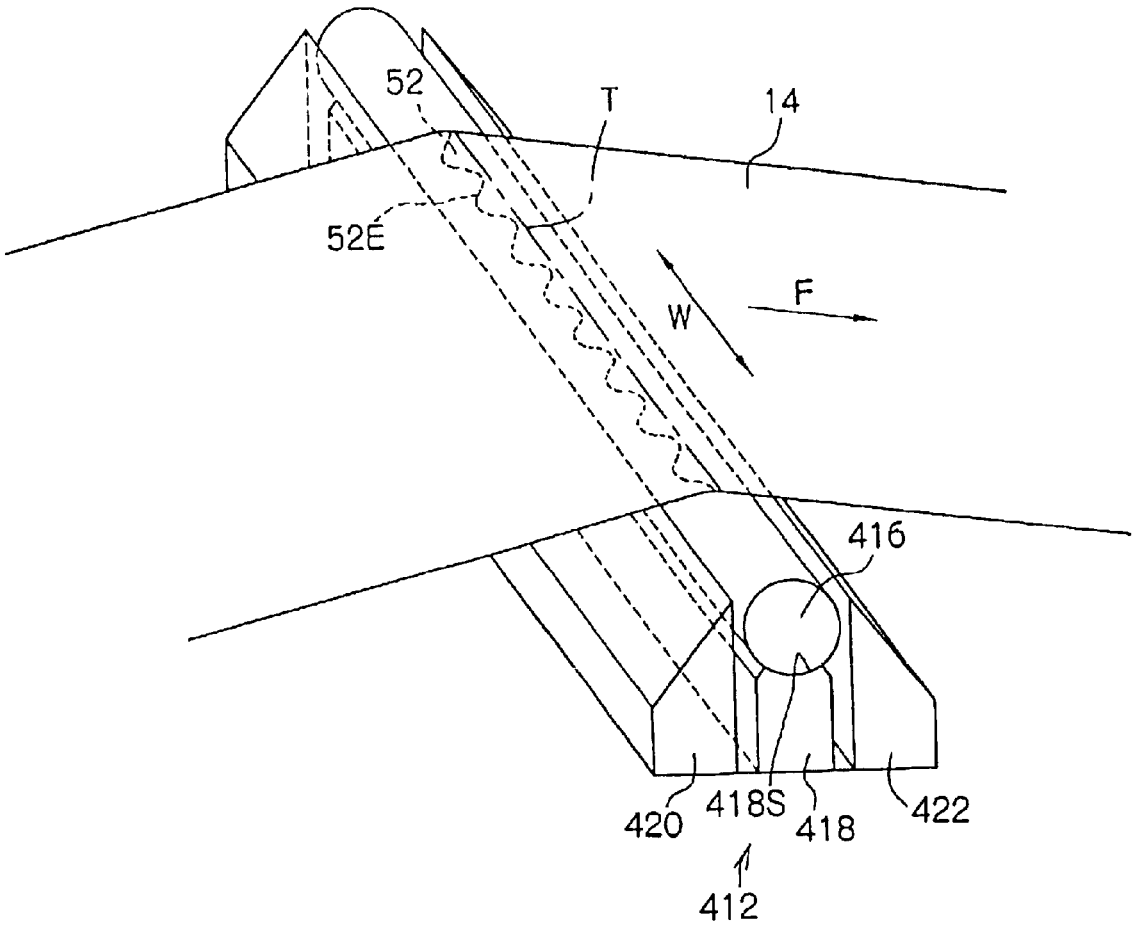
FIG. 19 is a perspective view showing a schematic structure of the bar coating apparatus according to an eighth embodiment of the invention.
Figure 20A:
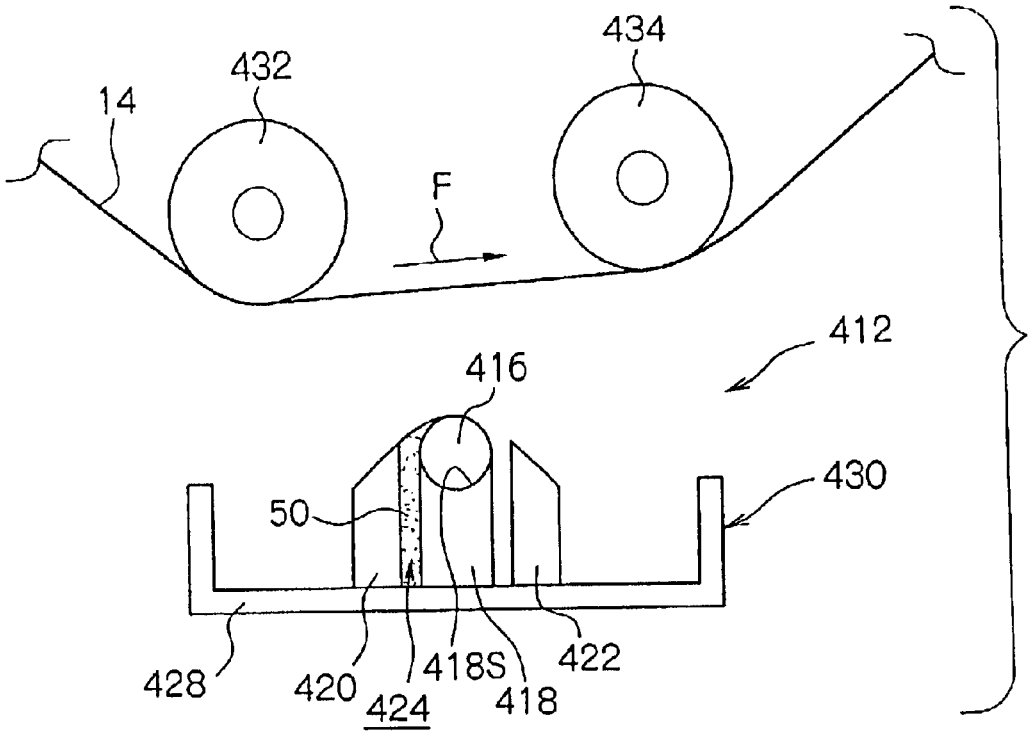
FIG. 20A is a front view showing a schematic structure of the bar coating apparatus when not coating, according to the eighth embodiment of the invention.
Figure 20B:
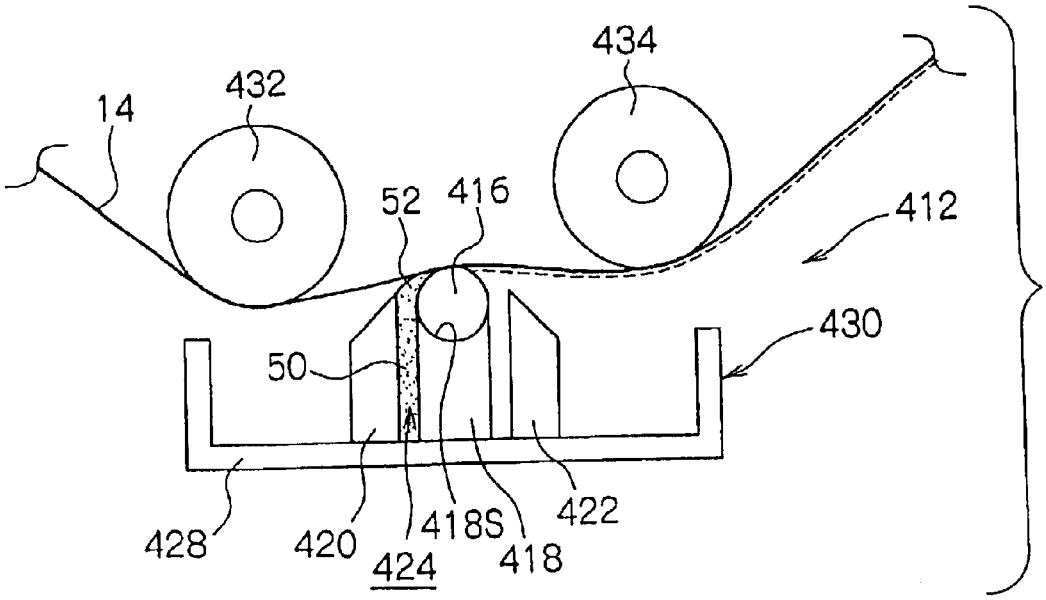
FIG. 20B is a front view showing a schematic structure of the bar coating apparatus when coating, according to the eighth embodiment of the invention.

FIGS. 19, 20A and 20B show a bar coating apparatus 412 according to the eighth embodiment. The bar coating apparatus 412 is incorporated into a manufacturing line of a planographic printing plate precursor. The bar coating apparatus 412 is used for applying a coating solution 50 (photosensitive solution or the like) to an aluminum web 14, which is a substrate of the planographic printing plate precursor. The aluminum web 14 is conveyed in the longitudinal direction thereof at a predetermined conveyance speed by a conveyance device (not shown).

The bar coating apparatus 412 has a coating bar 416 which is arranged so as to come in contact with the aluminum web 14 from below. The coating bar 416 is formed into an approximately columnar shape (or approximately cylindrical shape), and is supported by a bearing member 418 so that its longitudinal direction coincides with the width direction of the aluminum web 14.

An upper surface of the bearing member 418 is a supporting surface 418S which is formed into an arc shape along an outer peripheral surface of the coating bar 416. The coating bar 416 contacts the supporting surface 418S and is rotatably supported thereon.

Weir plates 420 and 422 are arranged on upstream and downstream sides of the bearing member 418, respectively. Predetermined clearances are provided between the weir plates 420, 422 and the bearing member 418, respectively. The clearance between the weir plate 420 on the upstream side and the bearing member 218 serves as a coating solution supply path 424. A coating solution 50, which is fed from a coating solution supply device (not shown), passes through the coating solution supply path 424 and is successively raised by rotation of the coating bar 416 so as to be transferred to the aluminum web 14. Moreover, the bead 52 of the coating solution 50 is formed among the aluminum web 14, the weir plate 420 and the coating bar 416 on the upper stream side of a contact portion between the aluminum web 14 and the coating bar 416.

As shown in FIGS. 20A and 20B, the bearing member 418 and the weir plates 420, 422 are held integrally by a holder 428 so as to compose a coating device 430. Moreover, support rolls 432 and 434 which come in contact with the aluminum web 14 from the opposite side to the coating device 430 (i.e., from above the aluminum web 14) are disposed both upstream and downstream of the coating device 430, respectively (in FIG. 19, the support rolls 432 and 434 are not shown). When the support rolls 432 and 434 press down upon the aluminum web 14 from above, a predetermined tension is being applied to the aluminum web 14, and thus, the aluminum web 14 can be brought into contact with the coating bar 416.

When an elevating device (not shown) is driven, the bearing member 418 and the weir plates 420, 422 composing the coating device 430 can be integrally moved vertically. As shown in FIG. 20A, in a state where the coating device 430 is lowered down away from the aluminum web 14, the coating bar 416 does not come in contact with the aluminum web 14. Therefore, the coating solution 50 is not applied to the aluminum web 14. However, as shown in FIG. 20B, by lifting up the coating device 430, the coating bar 416 is brought into contact with the aluminum web 14, and the aluminum web 14 can be coated with the coating solution 50. Moreover, while the state that the coating bar 16 contacts with the aluminum web 14 is being maintained, the coating device 430 is moved vertically slightly, so that a desired contact pressure can be provided. As a result, appropriate coating can be carried out to meet the needs of different types of aluminum webs 14 and coating solutions 50.

Figure 21:
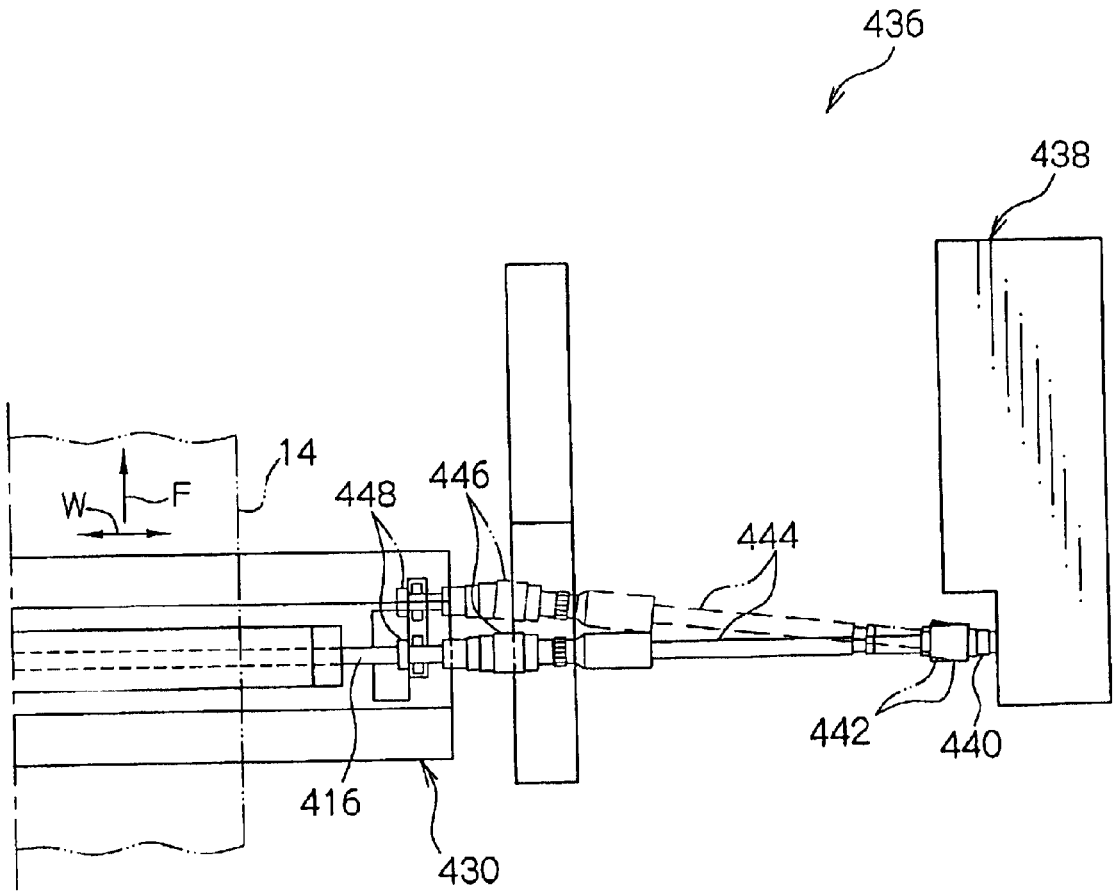
FIG. 21 is a plan view showing the rotation drive of the bar coating apparatus according to the eighth embodiment of the invention.
Figure 22:
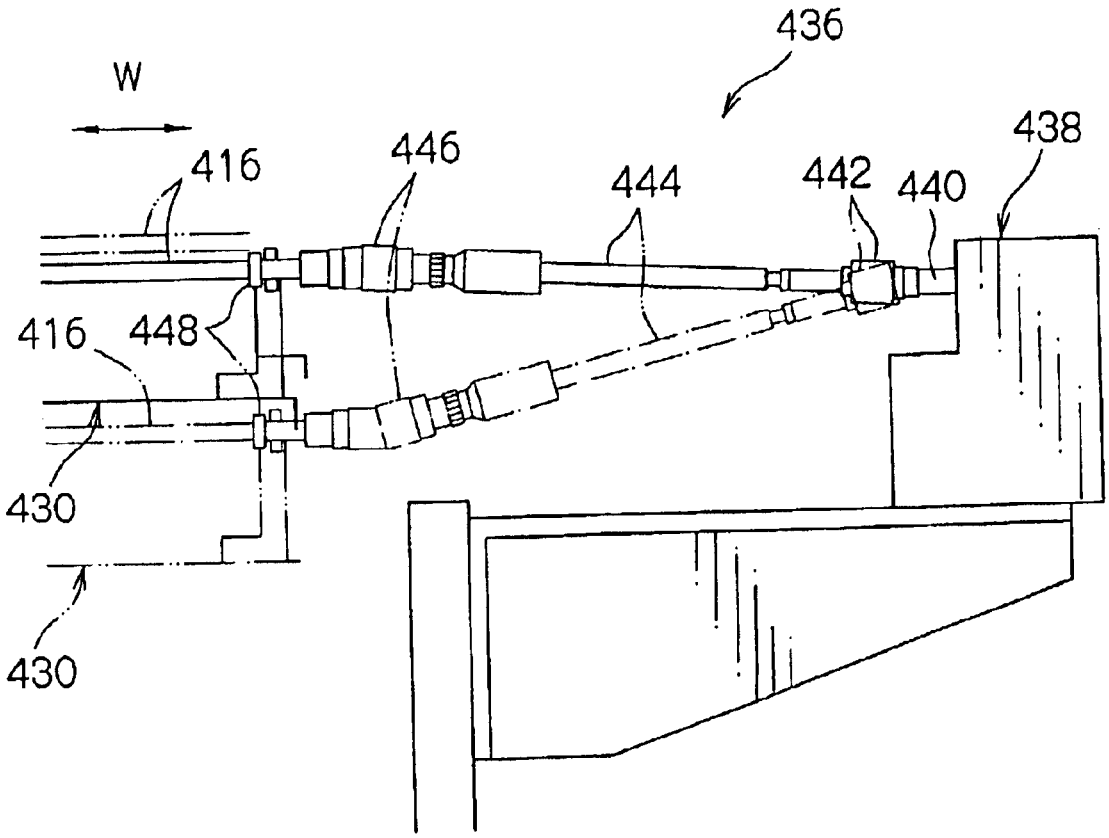
FIG. 22 is a side view showing the rotation drive of the bar coating apparatus according to the eighth embodiment of the invention.
Figure 23:
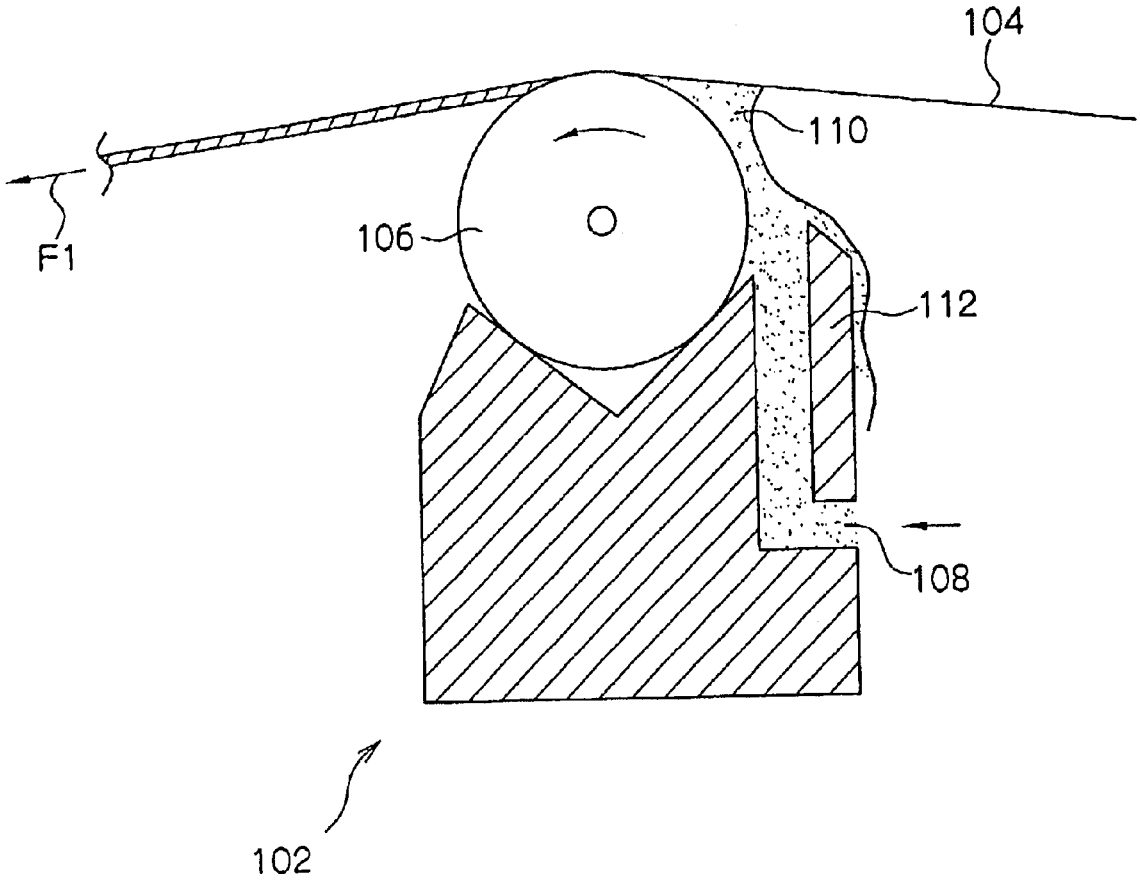
FIG.23 PRIOR ART
FIG. 23 is a cross section showing a schematic structure of a conventional bar coating apparatus.

FIGS. 21 and 22 show schematic structures of a rotation drive 436 for driving the rotation of the coating bar 416.

The rotation drive 436 is structured to include a motor and a reduction device and the like, and has a drive source 438 for generating a rotational driving force at a predetermined torque and at a predetermined angular velocity. An output shaft 440 of the drive source 438 is connected to a shaft 444 via a first universal joint 442. Further, the shaft 444 is connected to a switching member 448 via a second universal joint 446. The switching member 448 moves between a transmission position where the switching member 448 is connected to the coating bar 416 to enable to transmit rotational driving force thereto (a position shown by a solid line in FIG. 21) and a non-transmission position, where the connection with the coating bar 416 is released and the rotational driving force is not transmitted (a position shown by the two-dot chain line in FIG. 21).

In addition, since the drive source 438 is connected to the coating bar 416 via the two universal joints 442 and 446, the rotational driving force of the drive source 438 can be transmitted to the coating bar 416 while an angle between the output shaft 440 of the drive source 438 and the coating bar 416 is being always kept constant. For example, in the case where the coating device 430 is slightly moved vertically or, as shown by the two-dot chain line in FIG. 22, the coating device 430 is lowered down so that the coating bar 416 is separated from the aluminum web 14, the output shaft 440 of the drive source 438 is parallel with the coating bar 416, and the coating bar 416 receives the rotational driving force of the drive source 438 so as to rotate.

In the bar coating apparatus 412 of the present embodiment, the coating bar 416 can be actively rotated by the rotational driving force from the drive source 438 so that a peripheral speed of the coating bar 416 differs from a peripheral speed corresponding to the conveyance speed of the aluminum web 14.

Next, a method of applying the coating solution 50 to the aluminum web 14 using the bar coating apparatus 412 of the present embodiment and a function of the bar coating apparatus 412 will now be described.

When the coating solution 50 is applied to the aluminum web 14, the aluminum web 14 is conveyed at a constant conveyance speed by the conveyance device (not shown).

In addition, as shown in FIG. 20B, the coating device 430 is lifted up and the coating bar 416 is brought into contact with the aluminum web 14, and the coating solution 50 is supplied from the coating solution supply device (not shown). In the bar coating apparatus 412 of the present embodiment, the switching member 448 is moved to the transmission position of the driving force when coating, as shown by a solid line in FIG. 21. The rotational driving force of the drive source 438 can be transmitted to the coating bar 416. As a result, the coating bar 416 is actively rotated at a peripheral speed, which differs from a peripheral speed corresponding to the conveyance speed of the aluminum web 14.

Generally, when the bead 52 is arranged among the aluminum web 14, the weir plate 420 and the coating bar 416, and the bead 52 is viewed from a contact portion T between the aluminum web 14 and the coating bar 416 (shown by the chain line in FIG. 19), in the case where an edge portion 52E of the bead 52 draws a periodic curved line in the width direction, the coated surface quality becomes fine. Particularly when the edge portion 52E has a sine curve shape or a shape close to a sine curve, the coated surface quality becomes even better.

As mentioned above, the peripheral speed of the coating bar 416 is set to be different from the peripheral speed corresponding to the conveyance speed of the aluminum web 14. As a result, the edge portion 52E of the bead 52 has a shape similar to the sine curve, and the bead 52 is maintained stably. Therefore, streak coating of the coating solution 50 or the like due to disturbance of the bead does not occur, and a uniform coated surface quality can be obtained.

Particularly in cases where the coating solution 50 having a high viscosity is used, or in cases where the conveyance speed of the aluminum web 14 is increased, the edge portion 52E of the bead 52 has a shape similar to a sine curve, and the bead 52 can be maintained stably. Therefore, the coated surface quality can be uniform. From this viewpoint, the rotation speed of the coating bar 416 is not particularly limited as long as it is a peripheral speed different from the peripheral speed corresponding to the conveyance speed of the aluminum web 14. However, it is preferable that the rotation speed is within ±500 rpm and more preferably within ±200 rpm. Here, "+" shows the case where the contact portion of the coating bar 416 with the aluminum web 14 moves to the same direction as the conveyance direction of the aluminum web 14. Therefore, in the case of "−", the contact portion of the coating bar 416 with the aluminum web 14 moves to the opposite direction to the conveyance direction of the aluminum web 14.

In the present embodiment, the coating bar 416 is essentially rotated at a lower speed than that in the conventional structure where the coating bar 416 is rotated by friction with the aluminum web 14 (the rotational driving force is not given). Therefore, splashing of the coating solution 50 (so-called solution spattering) can be prevented when the coating solution 50 is raised by the coating bar 416.

In addition, when the coating bar 416 is rotated at a lower speed than that in the conventional structure, the coating solution 50 composing the bead 50 can be prevented also from wrapping around to the downstream from the contact portion 54 on both ends of the aluminum web 14 in the width direction. Therefore, so-called thick-coating of the coating solution 50 on both the ends of the aluminum web 14 in the width direction can be also prevented.

Needless to say, there are occasions when it is preferable that the coating bar 416 is rotated (driven) by friction with the aluminum web 14 similarly to the conventional structure, depending on the conveyance speed of the aluminum web 14, the viscosity of the coating solution 50 and the other conditions. In such instances, the rotational driving force of the drive source 438 can be easily prevented from being transmitted to the coating bar 416 just by moving the switching member 448 to the non-transmission position of the driving force, as shown by the two-dot chain line in FIG. 21.

As the coating bars 16, 216, 316 and 416 of the invention, the following can be used: A bar having a flat peripheral surface; a wire bar in which a wire is wound around the peripheral surface of the bar in the peripheral direction such that there are substantially no gaps between each wound loop and grooves are formed between adjacent wires; and further, a grooved bar in which a groove is provided along an entire length of the bar in the peripheral direction or in necessary portions, and the like can be used. It is preferable that an outer diameter of the coating bars 16, 216, 316 and 416 is within the range of ϕ1 to 30 mm from a viewpoint of bar rolling accuracy (straightness and roundness), angular moment (torque), weight balance and the like, and even more preferable within the range of ϕ6 to 20 mm.

In addition, the bearing members 18, 218, 318 and 418 are not limited as long as they can securely support the corresponding coating bars 16, 216, 316 and 416, respectively. However, when smooth rotation of the coating bars 16, 216, 316 and 416 is considered, the bearing members having a low coefficient of friction with the coating bars 16, 216, 316 and 416 are preferable, and further, the bearing members having high resistance to wear are preferable. As materials that satisfy the above-stated conditions, polyethylene resin, fluorine contained resin, polyacetal resin, and the like can be used. When at least the supporting surfaces 18S, 218S, 318S and 418S (portions that support the corresponding coating bars, respectively) are made of the above materials, the aforementioned effects can be produced.

The structure of the pressing member is not particularly limited as long as it is capable of pressing and preventing flapping of the aluminum web 14. For example, it is not necessary for the pressing member to be formed into the above-mentioned roll shape (columnar or cylindrical shape), and thus a bar-shaped member or a plate member may also be used. However, when the pressing member has a roll shape, it is preferable that its diameter is within the range of ϕ10 to ϕ200 mm, in terms of the planarity of the aluminum web 14 (supporting body) being secured and prevention of slip at the time of conveyance.

In addition, as the object to be coated (supporting body) to be coated with the coating solution 50 by means of the bar coating apparatuses 12, 212, 312 and 412, a band-type object or a sheet-type object may be used, such as a thin plate metal made of aluminum or the like (the above-mentioned aluminum web 14), paper, plastic film, resin coating paper, synthetic paper and the like. In the case where an aluminum plate is used as the supporting body of the planographic printing plate precursor, A1050, A1100 and A1070 which are pure aluminum materials according to the Japanese Industrial Standard (JIS) can be used, as well as aluminum alloy materials such as Al—Mg based alloy, Al—Mn based alloy, Al—Mn—Mg based alloy, Al—Zr based alloy and Al—Mg—Si based alloy. Materials of the plastic film that can be used are, polyolefines such as polyethylene and polypropylene, vinyl polymers such as polyvinyl acetate, polyvinyl chloride and polystyrene, polyamides such as 6,6-nylon and 6-nylon, polyesters such as polyethylene terephthalate and polyethylene-2,6-naphthalate, cellulose acetates such as polycarbonate, cellulose triacetate, cellulose diacetate or the like is used. Moreover, as the resin to be used for the resin coating paper, polyolefin including polyethylene is typical, but the resin is not limited to this.

The thickness of the aluminum web 14 is not particularly limited, but the aluminum web having a thickness of about 0.01 mm to 1.0 mm is advantageous in terms of handling and versatility.

Further, the coating solution 50 is not limited to the above-mentioned photosensitive solution, and other solution such as an aqueous solution of high-molecular compound, an organic aqueous solution, a pigment dispersion liquid, a colloidal solution, and the like can also be used. As the coating solution 50 for forming a photosensitive layer of the planographic printing plate precursor, photosensitive solutions that form photosensitive layers of the following modes (1) to (11) can be used:

(1) A mode where the photosensitive layer contains infrared absorber, a compound that generates acid due to heat, and a compound that crosslinks due to acid;

(2) A mode where the photosensitive layer contains an infrared absorber and a compound to be alkali resolvable due to heat;

(3) A mode where the photosensitive layer includes two layers, a layer containing a compound that generates a radical due to laser beam emission and a binder soluble with alkali and a multifunctional monomer or prepolymer and an oxygen barring layer;

(4) A mode where the photosensitive layer is composed of two layers: a physical phenomenon nucleus layer; and a silver halide emulsion layer;

(5) A mode where the photosensitive layer includes three layers, a polymeric layer containing a multifunctional monomer and multifunctional binder, a layer containing silver halide and a reducing agent, and an oxygen barring layer;

(6) A mode where the photosensitive layer is composed of two layers, a layer containing novolac resin and naphthoquinonediazido, and a layer containing silver halide;

(7) A mode where the photosensitive layer includes an organic photoconductor;

(8) A mode where the photosensitive layer is composed of two to three layers, a laser beam absorbing layer, which is removed by laser beam emission, and a lipophilic layer and/or a hydrophilic layer;

(9) A mode where the photosensitive layer contains a compound that absorbs energy and generates acid, a high-molecular compound having a functional group in a side chain that generates sulfonic acid or carboxylic acid due to acid, and a compound which absorbs visible light so as to give energy to an acid generator;

(10) A mode where the photosensitive layer contains a quinonediazide compound and a novolac resin;

(11) A mode where the photosensitive layer contains a compound that decomposes due to light or ultraviolet rays and forms a structure where its molecules are crosslinked (or its molecules are crosslinked with other molecules in the layer), and a binder that is soluble with alkali.

As the bar coating apparatus of the invention, the bar coating apparatuses 12, 212, 312 and 412, which apply the photosensitive solution to the aluminum web 14 (supporting body) in the manufacturing line that manufactures a planographic printing plate precursor, are described in the above explanation, but the apparatuses are not limited to the aforementioned usage.

Examples 1, 2, 3 and 4 of the invention will now be detailed. However, the invention is not limited to the Examples.

EXAMPLE 1

In Example 1, the bar coating apparatus 12 of the first embodiment was used to apply the coating solution 50 to the aluminum web 14.

First, an aluminum plate was subject to the necessary treatments such as graining, etching, electrolytic surface-roughing and anodizing, so as to obtain the aluminum web 14. The aluminum web 14 was coated with the coating solution 50 by the bar coating apparatus 12, then it was dried, and then wound up into a roll shape. In addition, the aluminum web was unwound, and the coated surface quality was evaluated by visual inspection.

The coating conditions were set as follows:

Width of the aluminum web: 500 mm
Thickness of the aluminum web: 0.3 mm, 0.2 mm
Conveyance speed: 50 m/min
Coating amount: 0.02 $l/m^2$
Diameter of the coating bar: 10 mm
Number of revolutions of the coating bar: −50/min (reverse rotation)
Viscosity of the coating solution: 5 mPa·s
Diameter of the pressing roll: ϕ50 mm
Pressing position: L: 30 mm The forcing amount P was changed variously according to the above conditions, so that the length CL of the clearance C, the coating properties of the coating solution 50 to the aluminum web 14, and the coated surface quality of the aluminum web 14 (particularly, coating streak due to disturbance of the bead) were evaluated. Moreover, as for a bar coating apparatus in the structure without the pressing roll 54, the same evaluation was made for comparison.

TABLE 1

| | Thickness of aluminum web | Existence/ nonexistence of pressing roll | Forcing amount P | Length of clearance | Coating properties (stability of bead) | Coated surface quality (existence/ nonexistence of coating streak) |
|---|---|---|---|---|---|---|
| Comparative Example 1-1 | 0.3 mm | Nonexistent | — | 6.0 mm | X (unstable) | X (existent) |
| Example 1-1 | 0.3 mm | Existent | 8 mm | 4.0 mm | ◎ (stable) | ◎ (nonexistent) |
| Example 1-2 | 0.2 mm | Existent | 8 mm | 5.5 mm | ○ (slightly unstable) | ○ (slightly existent) |
| Example 1-3 | 0.2 mm | Existent | 10 mm | 4.0 mm | ◎ (stable) | ◎ (nonexistent) |
| Example 1-4 | 0.2 mm | Existent | 14 mm | 1.0 mm | ◎ (stable) | ◎ (nonexistent) |
| Example 1-5 | 0.2 mm | Existent | 14.7 mm | 0.5 mm | ◎ (stable) | ◎ (nonexistent) |
| Example 1-6 | 0.2 mm | Existent | 15.2 mm | 0.1 mm | ◎ (stable) | ◎ (nonexistent) |

In the table, the ◎ symbol denotes an acceptable result, namely, where a problem or disadvantage did not arise. The ○ symbol denotes a result that is somewhat inferior to ◎ but that did not cause problems and disadvantages in practical use. Results marked by X indicate that problems and/or disadvantages arose.

As is clear, in the examples from Table 1, when the length CL of the clearance C is in a constant range (within 5.5 mm), the coating properties and the coated surface quality become acceptable, and particularly when the length CL of the clearance C does not exceed 4.0 mm (Example 1-1, Example 1-3 to Example 1-6), the coating properties and the coated surface quality became particularly better.

On the other hand, when coating was carried out by the bar coating apparatus in the structure without the pressing roll 54 (Comparative Example 1-1), the length CL of the clearance C could not be adjusted. As a result, the bead was unstable, and the coated surface quality deteriorated to an extent that causes problems and disadvantages.

EXAMPLE 2

In Example 2, the bar coating apparatus 212 of the fourth embodiment was used so as to apply the coating solution 50 to the aluminum web 14.

First, an aluminum plate was subject to the necessary treatments such as graining, etching, electrolytic surface-roughing, and anodizing, so as to obtain the aluminum web 14. The aluminum web 14 was coated with the coating solution 50 by the bar coating apparatus 212, then it was dried, and then wound up into a roll shape. Further, the aluminum web was unwound, and the coated surface quality was evaluated by visual inspection.

The coating conditions were set as follows:

Width of the aluminum web: 500 mm
Thickness of the aluminum web: 0.3 mm
Conveyance speed: 100 m/min
Coating amount: 0.02 $l/m^2$
Diameter of the coating bar: 10 mm
Number of revolutions of the coating bar: −50/min (reverse rotation)
Viscosity of the coating solution: 5 mPa·s
Diameter of the pressing roll: ϕ50 mm
Forcing amount P: 2 mm Normally, the conveyance speed of the aluminum web 14 in the manufacturing operation of the planographic printing plate precursor is mostly 50 m/min or less. Therefore, the above conveyance speed (100 m/min) is relatively high as the conveyance speed of the aluminum web 14 in the manufacturing operation of the planographic printing plate precursor.

The pressing position L was changed within the range of 10 to 150 mm according to the above conditions, so that the coating properties of the coating solution 50 to the aluminum web 14, and the coated surface quality of the aluminum web 14 (particularly, coating streak due to disturbance of the bead) were evaluated. Moreover, as for a bar coating apparatus in the structure without the pressing roll 54, the same evaluation was made for comparison.

As for the results, the evaluation was roughly divided into three ranges where the pressing position L was within a range of 10 mm to 60 mm (Example 2-1), a range greater than 60 mm to 100 mm (Example 2-2) and a range greater than 100 mm to 150 mm (Example 2-3). For this reason, the results are shown according to these three ranges, respectively.

TABLE 2

| | Existence/non-existence of pressing roll | Pressing position L | Coating properties (flapping of aluminum web) | Coated surface quality (existence/nonexistence of coating streak) |
|---|---|---|---|---|
| Comparative example 2-1 | Nonexistent | — | X (existent) | X (existent) |
| Example 2-1 | Existent | 10 mm to 60 mm | ◎ (nonexistent) | ◎ (nonexistent) |
| Example 2-2 | Existent | larger than 60 mm to 100 mm | ○ (extremely slightly existent) | ○ (extremely slightly existent) |
| Example 2-3 | Existent | larger than 100 mm to 150 mm | Δ (slightly existent) | Δ (slightly existent) |

In the table, the ◎ symbol denotes an acceptable result, namely, where problems or disadvantages did not arise. The ○ symbol denotes a result that is somewhat inferior to ◎ but that did not cause problems and disadvantages. The Δ symbol denotes a result that is inferior to ○ but that did not cause significant problems or disadvantages depending on the final usage of the planographic printing plate precursor. In other words, the planographic printing plate precursor is sufficiently useful even in cases where the result is denoted as Δ. Results marked by X indicates that problems and/or disadvantages arose.

As is clear from Table 2, when the pressing position L was within the range of 10 mm to 60 mm (Example 2-1), the flapping of the aluminum web 14 was extremely small, and the coated surface quality was good. Moreover, when the pressing position L was within the range greater than 60 mm to 100 mm (Example 2-2), coating streak occurred on the aluminum web 14 due to disturbance of the bead, but was extremely little, and problem and disadvantage practically did not arise. Further, when the pressing position L was adjusted within the range greater than 100 mm to 150 mm (Example 2-3), the similar coating streak as described above occurred, but problems did not arise depending on the usage of the planographic printing plate precursor.

On the other hand, when the coating was carried out by the bar coating apparatus in the structure without the pressing roll 254 (Comparative Example 2-1), the flapping of the aluminum web 14 was large and the bead was not stable, and coating streak occurred, and the coated surface quality deteriorated to an extent that causes problems and disadvantages.

EXAMPLE 3

In Example 3, the bar coating apparatus 312 of the seventh embodiment was used to apply the coating solution 50 to the aluminum web 14.

First, an aluminum plate was subject to the necessary treatments such as graining, etching, electrolytic surface-roughing and anodizing, so as to obtain the aluminum web 14. The aluminum web 14 was coated with the coating solution 50 by the bar coating apparatus 312, then it was dried, and then wound up into a roll shape. Further, the aluminum web was unwound, and the coated surface quality was evaluated by visual inspection.

The coating conditions were set as follows:

Width of the aluminum web: 500 mm
Thickness of the aluminum web: 0.3 mm
Conveyance speed: 100 m/min
Coating amount: 0.02 $l/m^2$
Diameter of the coating bar: 10 mm
Number of revolution of the coating bar: −50/min (reverse rotation)
Viscosity of the coating solution: 10 mPa·s
Diameter of the pressing roll: ϕ50 mm
Pressing position L: 30 mm Normally, the conveyance speed of the aluminum web 14 in the manufacturing operation of the planographic printing plate precursor is mostly 50 m/min or less. Therefore, the above conveyance speed (100 m/min) is relatively high as the conveyance speed of the aluminum web 14 in the manufacturing operation of the planographic printing plate precursor.

The length CL of the clearance C was changed within the range of 5.0 mm to 0.1 mm under the above conditions, and the coating properties of the coating solution 50 to the aluminum web 14 and the coated surface quality of the aluminum web 14 (particularly coating streak due to disturbance of the bead) were evaluated for the respective lengths. Moreover, the similar evaluation was made in the case where the length CL of the clearance C was adjusted to 7.0 mm and 6.0 mm as comparison.

TABLE 3

| | Length of clearance | Coating properties (stability of bead) | Coated surface quality (existence/nonexistence of coating streak) |
|---|---|---|---|
| Comparative Example 3-1 | 7.0 mm | X (unstable) | X (existent) |
| Comparative Example 3-2 | 6.0 mm | X (unstable) | X (existent) |
| Example 3-1 | 5.0 mm | ○ (stable) | ○ (nonexistent) |
| Example 3-2 | 4.0 mm | ○ (stable) | ○ (nonexistent) |
| Example 3-3 | 1.0 mm | ○ (stable) | ○ (nonexistent) |
| Example 3-4 | 0.5 mm | ○ (stable) | ○ (nonexistent) |
| Example 3-5 | 0.1 mm | ○ (stable) | ○ (nonexistent) |

In the Table, the ○ symbol denotes an acceptable result, namely, where problems and disadvantages did not arise, and the X symbol denotes that problems and/or disadvantages arose.

As is clear from Table 3, when the length CL of the clearance C was adjusted within the range of 0.1 mm to 5.0 mm (Examples 3-1 to 3-5), the bead became stable, and the coated surface quality was good.

On the other hand, when the length CL of the clearance C was adjusted to 7.0 mm and 6.0 mm (Comparative Examples 3-1 and 3-2), the bead was not stable, and coating streak was generated, and the coated surface quality deteriorated to an extent that causes problems and disadvantages.

The coating conditions were set as follows:

Width of the aluminum web: 500 mm
Thickness of the aluminum web: 0.3 mm
Conveyance speed: 150 m/min
Coating amount: 0.02 $l/m^2$
Diameter of the coating bar: 10 mm
Number of revolution of the coating bar: −50/min (reverse rotation)
Viscosity of the coating solution: 15 mPa·s In addition, as the comparative example, when the conveyance speed of the aluminum web 14 was 50 m/min and the viscosity of the coating solution was 2 mPa·s or 5 mPa·s (Comparative Example 4-1 or 4-2), when the conveyance speed of the aluminum web 14 was 100 m/min and the viscosity of the coating solution was 5 mPa·s (Comparative Example 4-3) and when the conveyance speed of the aluminum web 14 was 150 m/min and the viscosity of the coating solution was 15 mPa·s (Comparative Example 4-4), coating bar 416 was driven to be rotated by friction with the aluminum web 14, so that the coated surface quality could be evaluated similarly to the Examples 4-1 to 4-6.

Normally, the conveyance speed of the aluminum web 14 in the manufacturing operation of the planographic printing plate precursor is mostly 50 m/min or less. Therefore, the above conveyance speed (100 m/min and 150 m/min) is relatively high as the conveyance speed of the aluminum web 14 in the manufacturing operation of the planographic printing plate precursor.

TABLE 4

| | Number of revolutions of coating bar (/min) | Conveyance speed (m/min) | Viscosity of coating solution (mPa · s) | Coating properties (stability of bead) | Coated surface quality (existence/nonexistence of coating streak) |
|---|---|---|---|---|---|
| Comparative Example 4-1 | +1590 (driven) | 50 | 2 | ○ (stable) | ○ (nonexistent) |
| Comparative Example 4-2 | +1590 (driven) | 50 | 5 | X (unstable) | X (existent) |
| Comparative Example 4-3 | +3180 (driven) | 100 | 5 | X (unstable) | X (existent) |
| Comparative Example 4-4 | +4770 (driven) | 150 | 15 | X (unstable) | X (existent) |
| Example 4-1 | +700 drive | 150 | 15 | Δ (slightly unstable) | Δ (slightly existent) |
| Example 4-2 | +500 drive | 150 | 15 | ○ (stable) | ○ (nonexistent) |
| Example 4-3 | +200 drive | 150 | 15 | ◎ (extremely stable) | ◎ (nonexistent) |
| Example 4-4 | −200 drive | 150 | 15 | ◎ (extremely stable) | ◎ (nonexistent) |
| Example 4-5 | −500 drive | 150 | 15 | ○ (stable) | ○ (nonexistent) |
| Example 4-6 | −700 drive | 150 | 15 | Δ (slightly unstable) | Δ (slightly existent) |

EXAMPLE 4

In Example 4, the bar coating apparatus 412 of the eighth embodiment was used to apply the coating solution 50 to the aluminum web 14.

First, an aluminum plate was subject to the necessary treatments such as graining, etching, electrolytic surface-roughing and anodizing, so as to obtain the aluminum web 14. The aluminum web 14 was coated with the coating solution 50 by the bar coating apparatus 412 (at this time, as shown in the following Table 4, the coating bar 416 was rotated at a peripheral speed different from a peripheral speed corresponding to the conveyance speed of the aluminum web 14), then it was dried, and then wound up into a roll shape. Further, the aluminum web was unwound, and the coated surface quality was evaluated by visual inspection.

In the table, the ◎ symbol denotes an acceptable result, namely, where problems and disadvantages did not arise. The ○ symbol denotes a result that is somewhat inferior to ◎ but did not cause problems and disadvantages in practical use. The Δ symbol denotes a result that is further inferior to ○ but did not cause significant problems or disadvantages depending on the final usage of the planographic printing plate precursor. In other words, the planographic printing plate precursor is sufficiently useful even in cases where the result is denoted as Δ. Results marked by X indicates that problems and/or disadvantages arose.

As is clear from Table 4, in the case where the coating bar 416 rotated at a peripheral speed different from a peripheral speed corresponding to the conveyance speed of the aluminum web 14, even when the conveyance speed of the aluminum web 14 was high and the viscosity of the coating solution 50 was high, the coated surface quality was good (see Example 4-1 through Example 4-6). Particularly when the coating bar 416 rotated in the range of +500 rpm to −500 rpm, the coated surface quality was good regardless of types and applications of the planographic printing plate precursor (see Example 4-2 through Example 4-5). When the coating bar 416 rotated in the range of +200 rpm to −200 rpm, the coated surface quality of the planographic printing plate precursor was even better (see Example 4-3 and Example 4-4).

On the other hand, in the case where the coating bar 416 was driven to be rotated, when the conveyance speed of the aluminum web 14 was 50 m/min and the viscosity of the coating solution 50 was 2 mPa·s (Comparative Example 4-1), the bead was stable and good coated surface quality could be obtained. However, when the viscosity of the coating solution 50 was 5 mPa·s (Comparative Example 4-2) and the conveyance speed of the aluminum web 14 was 100 m/min (Comparative Example 4-3), and in the case where the viscosity of the coating solution was 15 mPa·s and the conveyance speed of the aluminum web 14 was 150 m/min (Comparative Example 4-4), the bead was unstable, and the coated surface quality deteriorated to an extent that causes problems and inconveniences.

Since the invention has the above structure, even if the conveyance speed of the object to be coated is increased or the viscosity of the coating solution is increased, the uniform coated surface quality can be obtained.

What is claimed is:

1. A bar coating method of bringing a coating bar into contact with an object to be coated, which object is conveyed in a constant direction, comprising the steps of:

a. supplying the object to be coated;

b. pressing, with a pressing member disposed near the coating bar, the object to be coated from a side thereof opposite from the coating bar, wherein a distance between a center of the coating bar and a pressing position of the pressing member is within a range of 15 to 60 mm;

c. moving, in correspondence to a coating state, the pressing member in a thickness direction of the object to be coated; and d. applying a coating solution to and removing excess coating solution from the object to be coated.

2. The bar coating method of claim 1, wherein the coating bar is rotated at a peripheral speed that differs from a peripheral speed corresponding to the speed at which the object to be coated is conveyed.

3. A bar coating method of bringing a coating bar into contact with an object to be coated, which object is conveyed in a constant direction, comprising the steps of:

a. supplying the object to be coated;

b. forming a bead of the coating solution between the object to be coated and the coating bar with a weir member disposed upstream of the coating bar in a direction in which the object to be coated is conveyed; and c. applying a coating solution to and removing excess coating solution from the object to be coated, wherein a clearance between the weir member and the object to be coated is maintained at a predetermined value of no more than 5 mm.

4. The bar coating method of claim 3, wherein the coating bar is rotated at a peripheral speed that differs from a peripheral speed corresponding to the speed at which the object to be coated is conveyed.

5. The bar coating method according to claim 3, further comprising:

pressing, with a pressing member disposed near the coating bar, the object to be coated from a side thereof opposite from the coating bar, wherein a distance between a center of the coating bar and a pressing position of the pressing member is within a range of 15 to 60 mm.

6. A bar coating method of bringing a coating bar into contact with an object to be coated, which object is conveyed in a constant direction, comprising the steps of:

a. supplying the object to be coated;

b. rotating the coating bar at a peripheral speed that differs from a peripheral speed corresponding to the speed at which the object to be coated is conveyed;

c. forming a bead of a coating solution between the object to be coated and the coating bar with a weir member disposed upstream of the coating bar in a direction in which the object to be coated is conveyed; and d. applying a coating solution to and removing excess coating solution from the object to be coated, wherein a clearance between the weir member and the object to be coated is maintained at a predetermined value of no more than 5 mm.

7. The bar coating method of claim 6, wherein the number of revolutions of the coating bar is within ±500/mm.

8. A bar coating apparatus comprising:

a coating bar for contacting an object to be coated, which object is conveyed in a constant direction, so as to apply a coating solution to and remove excess coating solution from the object to be coated;

a weir member for forming a bead of the coating solution between the object to be coated and the coating bar, the weir member being disposed upstream of the coating bar in a direction in which the object to be coated is conveyed;

a pressing member for pressing the object to be coated from a side thereof opposite from the coating bar, the pressing member being disposed near the coating bar; and a moving device for moving the pressing member in a thickness direction of the object to be coated, wherein a distance between a center of the coating bar and a pressing position of the pressing member on the object to be coated is within a range of 15 to 60 mm.

9. The bar coating apparatus of claim 8, wherein the pressing member is a pressing roll that is rotatingly driven by friction with the object to be coated.

10. The bar coating apparatus of claim 9, further comprising a rotational drive for rotating the coating bar at a peripheral speed that differs from a peripheral speed corresponding to the speed at which the object to be coated is conveyed.

11. A bar coating apparatus comprising:

a coating bar for contacting an object to be coated, which object is conveyed in a constant direction, so as to apply a coating solution to and remove excess coating solution from the object to be coated;

a weir member for forming a bead of the coating solution between the object to be coated and the coating bar, the weir member being disposed upstream of the coating bar in a direction in which the object to be coated is conveyed; and a pressing member for pressing the object to be coated from a side thereof opposite from the coating bar, the member being disposed near the coating bar, wherein a distance between a center of the coating bar and a pressing position of the pressing member on the object to be coated is within a range of 15 to 60 mm.

12. The bar coating apparatus of claim 11, wherein the pressing member is a pressing roll that is rotatingly driven by friction with the object to be coated.

13. The bar coating apparatus of claim 12, further comprising a rotational drive for rotating the coating bar at a peripheral speed that differs from a peripheral speed corresponding to the speed at which the object to be coated is conveyed.

14. A bar coating apparatus comprising:

a coating bar for contacting an object to be coated, which object is conveyed in a constant direction, so as to apply a coating solution to and remove excess coating solution from the object to be coated;

a weir member for forming a bead of the coating solution between the object to be coated and the coating bar, the weir member being disposed upstream of the coating bar in a direction in which the object to be coated is conveyed; and a clearance-maintaining mechanism for maintaining clearance between the weir member and the object to be coated at a predetermined value of no more than 5 mm.

15. The bar coating apparatus of claim 14, further comprising a pressing member for pressing the object to be coated from a side thereof opposite from the coating bar, the member being disposed near the coating bar, wherein the clearance-maintaining mechanism comprises a moving device for moving at least one of the weir member and the pressing member in a thickness direction of the object to be coated.

16. The bar coating apparatus according to claim 15, further comprising a rotational drive for rotating the coating bar at a peripheral speed that differs from a peripheral speed corresponding to the speed at which the object to be coated is conveyed.

17. A bar coating apparatus comprising:

a coating bar for contacting an object to be coated, which object is conveyed in a constant direction, so as to apply a coating solution to and remove excess coating solution from the object to be coated;

a weir member for forming a bead of the coating solution between the object to be coated and the coating bar, the weir member being disposed upstream of the coating bar in a direction in which the object to be coated is conveyed;

a rotational drive for rotating the coating bar at a peripheral speed that differs from a peripheral speed corresponding to the speed at which the object to be coated is conveyed; and a clearance-maintaining mechanism for maintaining clearance between the weir member and the object to be coated at a predetermined value of no more than 5 mm.

18. The bar coating apparatus of claim 17, wherein the number of revolutions of the coating bar is within ±500/mm.

19. The bar coating apparatus of claim 18, further comprising a switching mechanism for switching a rotational driving force of the rotational drive between a transmitting state, in which the driving force is transmitted to the coating bar, and a non-transmitting state, in which the driving force is not transmitted to the coating bar.

* * * * *